US008871418B2

(12) United States Patent
Sugiura et al.

(10) Patent No.: US 8,871,418 B2
(45) Date of Patent: Oct. 28, 2014

(54) TONER, TWO COMPONENT DEVELOPER, PROCESS CARTRIDGE AND COLOR IMAGE FORMING APPARATUS

(75) Inventors: Hideki Sugiura, Shizuoka (JP); Yuka Mizoguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 417 days.

(21) Appl. No.: 13/103,299

(22) Filed: May 9, 2011

(65) Prior Publication Data

US 2011/0281209 A1 Nov. 17, 2011

(30) Foreign Application Priority Data

May 14, 2010 (JP) ..... 2010-112655
Mar. 29, 2011 (JP) ..... 2011-072627

(51) Int. Cl.

*G03G 9/093* (2006.01)
*G03G 9/08* (2006.01)
*G03G 9/087* (2006.01)
*G03G 15/08* (2006.01)

(52) U.S. Cl.

CPC ..... *G03G 15/08* (2013.01); *G03G 9/09392* (2013.01); *G03G 2215/0602* (2013.01); *G03G 9/0827* (2013.01); *G03G 9/0819* (2013.01); *G03G 9/08797* (2013.01); *G03G 9/09321* (2013.01); *G03G 9/09371* (2013.01); *G03G 9/0821* (2013.01)

USPC ..... 430/110.2; 430/110.1; 430/110.3; 430/110.4; 430/111.4

(58) Field of Classification Search

CPC . G03G 9/093; G03G 9/09307; G03G 9/0819; G03G 9/0821; G03G 9/0827; G03G 9/08797

USPC ..... 430/110.2, 100–105, 106.1, 106.2, 430/106.3, 107.1, 108.1, 108.11, 108.14, 430/108.15, 108.2, 108.21, 108.22, 108.23, 430/108.24, 108.3, 108.4, 108.5, 108.6, 430/108.7, 108.8, 108.9, 109.1, 109.2, 430/109.3, 109.4, 109.5, 110.1, 110.3, 430/110.4

See application file for complete search history.

(56) References Cited

U.S. PATENT DOCUMENTS

| | | | | |
|---|---|---|---|---|
| 7,261,989 | B2 | 8/2007 | Sugiura et al. | |
| 7,318,989 | B2 | 1/2008 | Kotsugai et al. | |
| 7,368,212 | B2 | 5/2008 | Sugiura et al. | |
| 7,374,851 | B2 | 5/2008 | Nakayama et al. | |
| 7,521,164 | B2 | 4/2009 | Nakayama et al. | |
| 7,566,521 | B2 | 7/2009 | Kotsugai et al. | |
| 7,642,032 | B2 | 1/2010 | Sugiura et al. | |
| 7,759,036 | B2 | 7/2010 | Utsumi et al. | |
| 2008/0305423 | A1 | 12/2008 | Sugiura et al. | |
| 2009/0220883 | A1 * | 9/2009 | Sugiura | 430/109.4 |

FOREIGN PATENT DOCUMENTS

| | | |
|---|---|---|
| JP | 2006-267231 | 10/2006 |

* cited by examiner

*Primary Examiner* — Christopher Rodee
*Assistant Examiner* — Omar Kekia
(74) *Attorney, Agent, or Firm* — Oblon, Spivak, McClelland, Maier & Neustadt, L.L.P.

(57) ABSTRACT

A toner containing: a core containing at least a first binder resin, a colorant, and a releasing agent; and a shell containing at least a second binder resin; wherein the toner has a core-shell structure, and has a softening index of 86° C. to 95° C. and a thermal hardness of 0.7 to 1.8.

12 Claims, 7 Drawing Sheets

TONER, TWO COMPONENT DEVELOPER, PROCESS CARTRIDGE AND COLOR IMAGE FORMING APPARATUS

BACKGROUND OF THE INVENTION

1. Field of the Invention

The present invention relates to a toner, a two component developer, a process cartridge and a color image forming apparatus.

2. Description of the Related Art

In image forming apparatuses, such as an electrophotographic apparatus and an electrostatic recording apparatus, a latent electrostatic image formed on a photoconductor is developed with a developer containing a toner so as to form a toner image, and the toner image is transferred onto a recording medium, such as paper, and then fixed by heating, to thereby form an image.

A full-color image is generally formed in such a manner that images are developed with toners of four colors consisting of black, yellow, magenta and cyan, and toner images of respective colors are transferred and superimposed onto a recording medium, and simultaneously fixed thereon by heating, to thereby form the full-color image.

Recently, in terms of energy saving and downsizing of apparatuses, such as an image forming apparatus, it has been demanded to decrease a temperature for heating at the time of toner fixation. A toner having low temperature fixing ability, which satisfies such demand, is desired. Moreover, a toner, which can use at high temperature and high humidity, e.g., a temperature of 45° C. and humidity of 80%, is desired, because image forming apparatuses are used in various environments, and frequencies of air conditioners used are reduced in offices due to promotion of energy saving, or the like.

Generally, the low temperature fixing ability of a toner is improved by a method of decreasing a softening temperature of the toner (News of Sanyo Chemical Industries, Ltd., No. 445, winter, 2007). However, when an image is output using a toner having a decreased softening temperature at high temperature and high humidity, a toner component melted at low temperature is attached to a carrier, causing carrier spent. Consequently, the charging ability of the carrier cannot be maintained, and a normal image cannot be formed.

As a technique of improving the low temperature fixing ability, there is a proposal that a core-shell toner containing a releasing agent, a colorant, a binder resin and a filler is used as a toner for developing an electrostatic charge image. The core-shell toner has ½ outflow temperature measured with a flow tester of 60° C. to 100° C., wherein the shell contains a thermoplastic resin (Japanese Patent Application Laid-Open (JP-A) No. 2006-267231).

However, in the proposed technique, the low temperature fixing ability of the toner is not sufficiently obtained at high temperature and high humidity, and the problem of carrier spent occurring at high temperature and high humidity has not been solved.

Therefore, at present, there is a demand for providing a toner, which has a low temperature fixing ability at high temperature and high humidity, e.g., a temperature of 45° C. and humidity of 80%, and can prevent carrier spent, a two-component developer, a process cartridge, and a color image forming apparatus, using the toner.

BRIEF SUMMARY OF THE INVENTION

The present invention solves conventional problems and achieves the following object. That is, the present invention aims to provide a toner having low temperature fixing ability at high temperature and high humidity, e.g., a temperature of 45° C. and humidity of 80%, and capable of preventing carrier spent, a two-component developer, a process cartridge, a color image forming apparatus, using the toner.

Means for solving the problems are as follows.

<1> A toner containing: a first binder resin; a second binder resin; a colorant; and a releasing agent, wherein the toner has a core-shell structure, where a core contains at least the first binder resin, the colorant and the releasing agent, and a shell contains at least the second binder resin, and wherein the toner has a softening index of 86° C. to 95° C. and a thermal hardness of 0.7 to 1.8.

<2> The toner according to <1>, further containing a crystalline polyester resin.

<3> The toner according to any of <1> and <2>, wherein the shell has a thickness of 0.01 μm to 2.0 μm.

<4> The toner according to any of <1> to <3>, wherein the second binder resin contains a vinyl resin.

<5> The toner according to any of <1> to <4>, wherein the first binder resin contains a polyester resin.

<6> The toner according to any of <1> to <5>, wherein the first binder resin contains an unmodified polyester resin.

<7> The toner according to any of <1> to <6>, wherein the toner is obtained by the method containing dispersing or emulsifying any of an oil phase and a monomer phase, which contain any of a toner composition and a toner composition precursor in an aqueous medium.

<8> The toner according to any of <1> to <7>, wherein the toner composition contains a polymer having a site reactive with an active hydrogen group-containing compound, a polyester resin, the colorant, and the releasing agent, and the toner composition is subjected to any of crosslinking reaction and elongation reaction in the aqueous medium in the presence of resin fine particles.

<9> The toner according to any of <1> to <8>, wherein the toner has an average circularity of 0.93 to 0.99.

<10> The toner according to any of <1> to <9>, wherein the toner has a shape factor SF-1 of 100 to 150, and a shape factor SF-2 of 100 to 140.

<11> The toner according to any of <1> to <10>, wherein the toner has a weight average particle diameter $D_4$ of 2 μm to 7 and a ratio $D_4/D_n$ of the weight average particle diameter $D_4$ to a number average particle diameter $D_n$ of 1.25 or less.

<12> The toner according to any of <1> to <11>, wherein the toner has a thermal hardness of 0.7 to 1.4.

<13> The toner according to any of <1> to <12>, wherein the shell has a thickness of 0.1 μm to 1.0 μm.

<14> A two-component developer containing the toner according to any of <1> to <13>, and a carrier having at least magnetic properties.

<15> A process cartridge including: a latent electrostatic image bearing member; and a developing unit configured to develop a latent electrostatic image formed on the latent electrostatic image bearing member using the toner according to any of <1> to <13> so as to form a visible image, wherein the process cartridge is detachably attached to an image forming apparatus.

<16> A color image forming apparatus comprising: a latent electrostatic image bearing member; a latent electrostatic image forming unit configured to form a latent electrostatic image on the latent electrostatic image bearing member; a developing unit configured to develop the latent electrostatic image using the toner according to any of <1> to <13> so as to form a visible image; a transferring unit configured to transfer the visible image onto a recording medium; and a fixing unit configured to fix the transferred image onto the recording medium using a fixing member, wherein the image forming apparatus employs a developing system using a plurality of the developing units for at least four developing colors, which are arranged in tandem, and wherein a linear velocity of the system is 500 mm/sec to 2,500 mm/sec, and a surface pressure of the fixing member is 10 N/cm$^2$ to 150 N/cm$^2$.

According to the present invention, conventional problems can be solved, and a toner having low temperature fixing ability at high temperature and high humidity, e.g., a temperature of 45° C. and humidity of 80%, and capable of preventing carrier spent, a two-component developer, a process cartridge, a color image forming apparatus, using the toner, can be provided.

DETAILED DESCRIPTION OF THE INVENTION

Toner

A toner of the present invention has a core-shell structure consisting of a core and a shell.

The toner contains at least a first binder resin, a second binder resin, a colorant and a releasing agent, and further contains other components, if necessary.

The core allows a toner to be designed for achieving the low temperature fixing ability, and a resin to have low softening property for achieving the low temperature fixing ability. The shell can protect a carrier and a developing unit from the releasing agent (e.g. wax), the coloring agent (e.g. a pigment) and insufficiently-charged components of the core which cause spent on the carrier and the developing unit.

<Softening Index and Thermal Hardness>

The toner has a softening index Ct of 86° C. to 95° C., and a thermal hardness St of 0.7 to 1.8.

The softening index Ct is a flow beginning temperature Tfb of a toner when a 25 kgf load is applied to the toner. The 25 kgf load is sufficient to break a core-shell structure of a toner. Thus, the softening index Ct denotes the softening properties of the core, since the softening index Ct is the flow beginning temperature Tfb of the toner whose core-shell structure is broken.

Figure 1A:
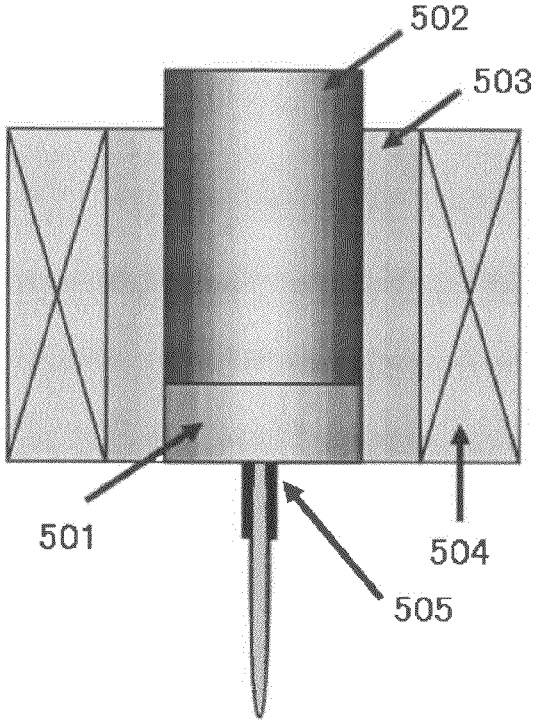
FIG. 1A shows a schematic view of a device for measuring a flow beginning temperature Tfb of a toner of the present invention.
Figure 1B:
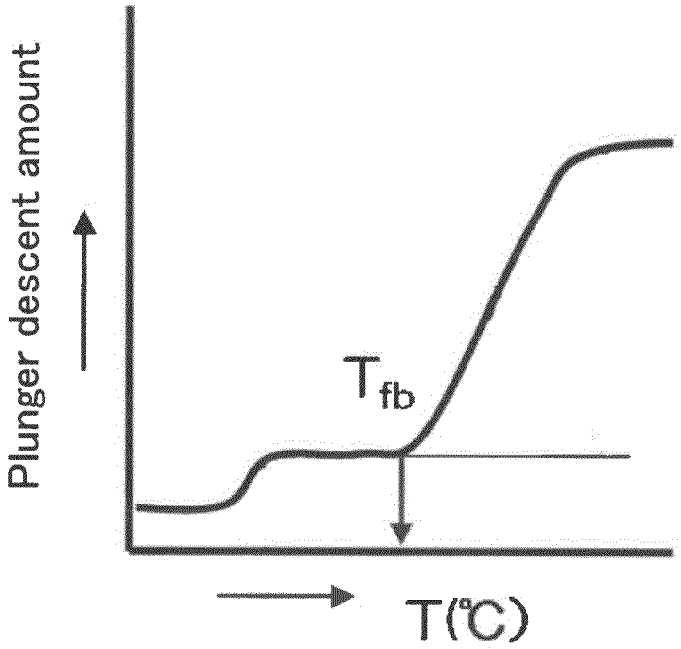
FIG. 1B shows an example of a flow curve for determining the flow beginning temperature Tfb of the toner of the present invention.

The flow beginning temperature Tfb can be measured using an elevated flow tester CFT-500D, manufactured by Shimadzu Corporation, in accordance with a method described in JIS K7210. Specifically, 1 g of a toner is pressure-molded into a cylindrical-shaped tablet 501 having 10 mm diameter and 10 mm height, and is placed inside a cylinder 503 in a test instrument shown in FIG. 1A. The tablet is heated at a temperature increasing rate of 3° C./min from a starting temperature of 50° C. using a heating body 504 while a certain load is applied to the tablet with a plunger 502, so as to extrude the melted toner through a nozzle 505 having 0.5 mm diameter and 1 mm length. Thus, a plunger descent amount-temperature curve is plotted. The flow curve obtained in this test plots the data as shown in FIG. 1B, and from the flow curve the flow beginning temperature Tfb can be determined.

In the measurement of the flow beginning temperature Tfb, the flow beginning temperature Tfb measured at 25 kgf load is the softening index Ct.

The softening index Ct of the toner is 86° C. to 95° C., more preferably 88° C. to 93° C. When the softening index Ct is lower than 86° C., despite the core of the toner being coated with the shell, the toner is influenced by heat and humidity of an external environment, causing carrier spent in the case where the toner is used at high temperature and high humidity, and causing decrease in heat resistant storage stability. When the softening index Ct is higher than 95° C., the core is not easily softened, causing insufficient low temperature fixing ability at high temperature and high humidity. In the case where the softening index Ct is within the above preferable range, it is advantageous that the softening temperature relevant to fixing ability, contamination such as carrier spent, etc. is easily controlled.

The thermal hardness St is obtained in the following manner. First, a load is varied in the range of 2 kgf to 25 kgf, and the flow beginning temperature Tfb of a toner at each of the loads is measured by the above-described method. Then, the relation between the load and the flow beginning temperature Tfb measured is plotted on an x-y plane, with a load on the x axis (a unit of the x axis is kgf), and Tfb on the y axis (a unit of the y axis is temperature ° C.), to thereby form a linear function. The absolute value of a slope of the linear function is the thermal hardness St.

The thermal hardness St is used as a characteristic value denoting ease of melting the toner with respect to the load. The larger the value of St is, the more largely the flow beginning temperature Tfb of the toner decreases according to the increase of the load. That is, the large value of St means that the toner is not started to be soft until the shell of the toner is broken by application of high load. Namely, the shell of the toner is hard, and the toner is not easily softened without application of high load. The larger the value of St is, the harder the thermal hardness of the shell is. On the other hand, as the value of St decreases, the flow beginning temperature Tfb of the toner less depends on the variation of the load. That is, when the value of St is small, the melting properties of the toner only depends on heat quantity, and the melting properties of the toner less changes even though the load is largely varied. Namely, the toner is easily melted without application of the sufficient load. Thus, the smaller the value of St means that the thermal hardness of the shell is soft.

The thermal hardness St of the toner is 0.7 to 1.8, more preferably 0.7 to 1.4. When the thermal hardness St is less than 0.7, the shell is excessively soft, causing carrier spent in the case where the toner is used at high temperature and high humidity, and causing decrease in heat resistant storage stability. When the thermal hardness St is more than 1.8, the shell is excessively hard, causing insufficient low temperature fixing ability in the case where the toner is used at high temperature and high humidity, and causing decrease in releasability of the releasing agent. In the case where the thermal hardness St is within the above preferable range, it is advantageous that the softening temperature relevant to fixing ability, contamination such as carrier spent, etc. is easily controlled.

That is, as the conditions of the toner which has low temperature fixing ability at high temperature and high humidity and can prevent carrier spent, it is necessary for the toner to have the softening index Ct of 86° C. to 95° C., and the thermal hardness St of 0.7 to 1.8.

The method for adjusting the softening index Ct to the range of 86° C. to 95° C. is not particularly limited and may be appropriately selected depending on the intended purpose. Examples thereof include a method of controlling a softening temperature of a resin by adjusting a molecular weight distribution of the resin and adjusting a monomer constituting the resin, a method of controlling a softening temperature by changing the type and amount of a crosslinking agent in a crosslinked toner, a method of appropriately selecting a melting point and type of a releasing agent (wax), and a method of adjusting a dispersibility of a releasing agent (wax).

A method of adjusting the thermal hardness St to the range of 0.7 to 1.8 is not particularly limited and may be appropriately selected depending on the intended purpose. Examples thereof include a method of controlling a softening temperature and hardness by adjusting the molecular weight distribution of a resin (e.g. the second binder resin) used for the shell, and the amount, ratio, etc, of a monomer constituting the resin, a method of controlling a thickness, formation state, and thickness distribution of the shell, a method of controlling the compatibility between a resin used for a core and a resin used for a shell, and a method of controlling a crosslinking properties of a resin (e.g. the first binder resin) used for a core.

<Core>

The core contains at least a first binder resin, a colorant, and a releasing agent.

—First Binder Resin—

The first binder resin is not particularly limited and may be appropriately selected depending on the intended purpose. The first binder resin preferably contains at least a polyester resin.

The polyester resin is not particularly limited and may be appropriately selected depending on the intended purpose. Examples thereof include a modified polyester resin and an unmodified polyester resin.

—Modified Polyester Resin—

The modified polyester resin is not particularly limited and may be appropriately selected depending on the intended purpose. Examples thereof include an isocyanate group-containing polyester prepolymer (A) as a polymer having a site reactive with an active hydrogen group-containing compound. Examples of the isocyanate group-containing polyester prepolymer (A) include a product obtained by reacting polyester which is a polycondensation product of polyol (1) and polycarboxylic acid (2) and has an active hydrogen group, with polyisocyanate (3). Examples of the active hydrogen group involved into the above-noted polyester include a hydroxyl group, such as an alcoholic hydroxyl group and a phenolic hydroxyl group, an amino group, a carboxyl group, and a mercapto group. Among these groups, an alcoholic hydroxyl group is preferable.

The polyol (1) is not particularly limited and may be appropriately selected depending on the intended purpose. Examples thereof include diol (1-1) and trihydric or higher polyol (1-2). A single use of the diol (1-1) or a mixture of the diol (1-1) with a small amount of the trihydric or higher polyol (1-2) is preferable. Examples of the diol (1-1) include alkylene glycols, such as ethylene glycol, 1,2-propylene glycol, 1,3-propylene glycol, 1,4-butanediol and 1,6-hexanediol; alkylene ether glycols, such as diethylene glycol, triethylene glycol, dipropylene glycol, polyethylene glycol, polypropylene glycol and polytetramethylene ether glycol; alicyclic diols, such as 1,4-cyclohexane dimethanol and hydrogenated bisphenol A; bisphenols, such as bisphenol A, bisphenol F and bisphenol S; alkylene oxide (e.g., ethylene oxide, propylene oxide, butylene oxide) adducts of the above-described alicyclic diols; alkylene oxide (e.g., ethylene oxide, propylene oxide, butylene oxide) adducts of the above-described bisphenols. Among these compounds, alkylene glycols having 2 to 12 carbon atoms and alkylene oxide adducts of bisphenols are preferably used, and alkylene oxide adducts of bisphenols and combinations of alkylene oxide adducts of bisphenols with alkylene glycols having 2 to 12 carbon atoms are more preferably used. Examples of the trihydric or higher polyol (1-2) include trihydric to octahydric or higher polyhydric aliphatic alcohols, such as glycerin, trimethylolethane, trimethylolpropane, pentaerythritol, and sorbitol; trihydric and higher phenols, such as trisphenol PA, phenol novolac, and cresol novolac; and alkylene oxide adducts of the above-mentioned trihydric or higher polyphenols.

The polycarboxylic acid (2) is not particularly limited and may be appropriately selected depending on the intended purpose. Examples thereof include dicarboxylic acid (2-1) and tri or higher polycarboxylic acid (2-2). A single use of the dicarboxylic acid (2-1) or a mixture of the dicarboxylic acid (2-1) with a small amount of the tri or higher polycarboxylic acid (2-2) is preferable. Examples of the dicarboxylic acid (2-1) include alkylene dicarboxylic acids, such as succinic acid, adipic acid, and sebacic acid; alkenylene dicarboxylic acids, such as maleic acid and fumaric acid; and aromatic dicarboxylic acids, such as phthalic acid, isophthalic acid, terephthalic acid, naphthalene dicarboxylic acid. Among these compounds, an alkenylene dicarboxylic acid having 4 to 20 carbon atoms, and an aromatic dicarboxylic acid having 8 to 20 carbon atoms are preferred. Examples of the tri or higher polycarboxylic acid (2-2) include aromatic polycarboxylic acid having 9 to 20 carbon atoms, such as trimellitic acid and pyromellitic acid. An acid anhydride of the polycarboxylic acid (2) or a lower alkyl ester, such as methyl ester, ethyl ester, and isopropyl ester may be reacted with the polyalcohol (1).

The ratio of the polyol (1) to the polycarboxylic acid (2), in terms of the equivalent ratio [OH]/[COOH] of a hydroxyl group [OH] to a carboxyl group [COOH], is usually 2/1 to 1/1, preferably 1.5/1 to 1/1, and more preferably 1.3/1 to 1.02/1.

The polyisocyanate (3) is not particularly limited and may be appropriately selected depending on the intended purpose. Examples thereof include aliphatic polyisocyanates such as tetramethylene diisocyanate, hexamethylene diisocyanate, and 2,6-diisocyanate methyl caproate; alicyclic polyisocyanates such as isophorone diisocyanate, and cyclohexyl methane diisocyanate; aromatic diisocyanates such as tolylene diisocyanate, and diphenylmethane diisocyanate; aromatic aliphatic diisocyanates such as α,α,α' α'-tetramethyl xylylene diisocyanate; isocyanurates; a compound in which the above-noted polyisocyanate is blocked with a phenol derivative, oxime, caprolactam, or the like; and combinations thereof.

The ratio of the polyisocyanate (3), in terms of the equivalent ratio [NCO]/[OH] of the isocyanate group [NCO] to the hydroxyl group [OH] of a polyester having the hydroxyl group, is usually 5/1 to 1/1, preferably 4/1 to 1.2/1, and more preferably 2.5/1 to 1.5/1. When the [NCO]/[OH] is more than 5/1, low temperature fixing ability may be adversely affected.

When the [NCO]/[OH] is less than 1/1, the urea content of the modified polyester resin may become lower, adversely affecting hot-offset resistance. The amount of the polyisocyanate (3) constituent in the isocyanate group-containing polyester prepolymer (A) is usually 0.5% by mass to 40% by mass, preferably 1% by mass to 30% by mass, and more preferably 2% by mass to 20% by mass. When it is less than 0.5% by mass, hot-offset resistance becomes poor and there appears disadvantage in satisfying both heat resistant storage stability and low temperature fixing ability. On the other hand, when it is more than 40% by mass, low temperature fixing ability may become poor.

The amount of the polyisocyanate group in one molecule of the isocyanate group-containing polyester prepolymer (A) is usually 1 or more, preferably 1.5 to 3 in average, and more preferably 1.8 to 2.5 in average. When amount of the polyisocyanate group is less than 1 in one molecule of the polyester prepolymer (A), the molecular weight of the modified polyester resin which has been subjected to cross-linking and/or elongation reaction becomes lower, adversely affecting the hot-offset resistance.

A cross-linking agent and/or elongation agent reacting with the isocyanate group-containing polyester prepolymer (A) is not particularly limited and may be appropriately selected depending on the intended purpose. For example, amines are used. The amines (B) are not particularly limited and may be appropriately selected depending on the intended purpose. Examples thereof include diamines (B1), tri or higher polyamines (B2), amino alcohols (B3), aminomercaptans (B4), amino acids (B5), and amino-blocked products (B6) of the amines from (B1) to (B5). Examples of the diamines (B1) include aromatic diamines, such as phenylenediamine, diethyltoluenediamine and 4,4'-diaminodiphenylmethane; alicyclic diamines, such as 4,4'-diamino-3,3'-dimethyldicyclohexylmethane, diaminecyclohexane and isophoronediamine; and aliphatic diamines, such as ethylenediamine, tetramethylenediamine and hexamethylenediamine. Examples of the tri or higher polyamines (B2) include diethylenetriamine and triethylenetetramine. Examples of the amino alcohols (B3) include ethanolamine and hydroxyethylaniline. Examples of the aminomercaptans (B4) include aminoethyl mercaptan and aminopropyl mercaptan. Examples of the amino acids (B5) include aminopropionic acid and aminocaproic acid. Examples of the amino-blocked products (B6) include ketimine compounds and oxazolidine compounds derived from the amines from (B1) to (B5) and ketones, such as acetone, methyl ethyl ketone and methyl isobutyl ketone. Among these amines (B), the diamines (B1), and a mixture of the diamines (B1) with a small amount of the tri or higher polyamines (B2) are preferable.

In crosslinking and/or elongation reaction of the polyester prepolymer (A) and the amines (B), if necessary, a reaction terminator may be used to control the molecular weight of a modified polyester resin to be obtained. Examples of the reaction terminator include monoamines, such as diethyl amine, dibutyl amine, butyl amine and lauryl amine; and blocked products thereof, such as ketimine compounds.

The mixing ratio of the isocyanate group-containing polyester prepolymer (A) to the amine (B) is not particularly limited but usually 1/2 to 2/1, preferably 1.5/1 to 1/1.5, more preferably 1.2/1 to 1/1.2, in terms of the equivalent ratio ([NCO]/[NHx]) of the isocyanate group [NCO] in the isocyanate group-containing polyester prepolymer (A) to the amino group [NHx] in the amine (B). When the equivalent ratio ([NCO]/[NHx]) is more than 2/1 or less than ½, the molecular weight of the modified polyester resin after the crosslinking and/or elongation reaction decreases, possibly causing the degraded hot offset resistance of the formed toner.

The amount of the modified polyester resin in the toner is not particularly limited and may be appropriately selected depending on the intended purpose. It is preferably 5% by mass to 50% by mass, more preferably 7% by mass to 30% by mass, particularly preferably 10% by mass to 20% by mass, with respect to the toner. When the amount of the modified polyester resin is less than 5% by mass, the crosslinking reaction and/or elongation reaction may not be sufficiently achieved, and hot offset resistance at fixing may decrease. When the amount of the modified polyester resin is more than 50% by mass, the crosslinking reaction and/or elongation reaction excessively proceeds, the formed toner may have degraded low temperature fixing ability. When the amount of the modified polyester resin is within the above-described particularly preferable range, it is advantageous in terms of the low temperature fixing ability, heat resistance storage stability, and carrier spent resistance.

—Unmodified Polyester Resin—

The unmodified polyester resin is preferably incorporated into the toner as the first binder resin, in combination with the modified polyester resin. By using the unmodified polyester resin in combination with the modified polyester resin in a toner, the low temperature fixing ability and the glossiness and gloss uniformity in the case of using the toner in a full-color image forming apparatus are improved.

The unmodified polyester resin is not particularly limited and may be appropriately selected depending on the intended purpose. Examples thereof include polycondensates of polyols (1) and polycarboxylic acids (2), which are similar to polyester components of the isocyanate group-containing polyester prepolymer (A). Preferable compounds thereof are also the same as in the isocyanate group-containing polyester prepolymer (A). As for the unmodified polyester resin, in addition to the unmodified polyester resin, they may be modified by a chemical bond other than urea bonds, for example, may be modified by a urethane bond. It is preferable that at least a part of the modified polyester resin be compatible with a part of the unmodified polyester resin, from the standpoint of low temperature fixing ability and hot-offset resistance. Thus, it is preferable that the polyester component of the modified polyester resin be similar to that of the unmodified polyester resin. A mass ratio of the modified polyester resin to the unmodified polyester resin is usually 5/95 to 75/25, preferably 10/90 to 25/75, more preferably 12/88 to 25/75, and particularly preferably 12/88 to 22/78. When the mass ratio of the modified polyester resin is less than 5% by mass, hot-offset resistance is adversely affected, causing disadvantages in satisfying both the heat resistant storage stability and low temperature fixing ability.

The number average molecular weight of the unmodified polyester resin is preferably 1,000 to 30,000, more preferably 1,500 to 10,000, and particularly preferably 2,000 to 8,000. When the number average molecular weight is less than 1,000, heat resistant storage stability may degrade, and when it is more than 30,000, the low temperature fixing ability may degrade. The hydroxyl value of the unmodified polyester resin is preferably 5 mgKOH/g or more, more preferably 10 mgKOH/g to 120 mgKOH/g, and particularly preferably 20 mgKOH/g to 80 mgKOH/g. When the hydroxyl value is less than 5 mgKOH/g, it causes disadvantage in satisfying both the heat resistant storage stability and the low temperature fixing ability. The acid value of the unmodified polyester resin is preferably 0.5 mgKOH/g to 40 mgKOH/g, and more preferably 5 mgKOH/g to 35 mgKOH/g. When the acid value of the unmodified polyester resin is within the above-mentioned range, the resulted toner tends to be negatively charged. Moreover, the unmodified polyester resin has the acid value and hydroxyl value outside these ranges, the resultant toner may be easily influenced by the environment, and an image may be easily degraded either under high temperature and high humidity, or low temperature and low humidity.

The amount of the unmodified polyester resin in the toner is not particularly limited and may be appropriately selected depending on the intended purpose. It is preferably 10% by mass to 95% by mass, more preferably 30% by mass to 90% by mass, particularly preferably 70% by mass to 90% by mass, relative to the toner. When the amount of the unmodified polyester resin is less than 10% by mass, the function of the binder resin of the toner may not be sufficiently exhibited. When the amount is more than 95% by mass, the amount of the colorant, releasing agent, etc. other than the resin may not be secured. When the amount of the unmodified polyester resin is within the above-described particularly preferable range, it is advantageous in terms that the function of the binder resin for the toner can be sufficiently exhibited, and that viscoelasticity of the toner can be suitably controlled.

—Colorant—

The colorant is not particularly limited and may be appropriately selected depending on the intended purpose. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower and lithopone.

The amount of the colorant is preferably 1% by mass to 15% by mass, more preferably 3% by mass to 10% by mass relative to the toner.

The colorant may be mixed with a resin to form a masterbatch. Examples of binder resins for use in the production of the master batch or in kneading with the master batch include, in addition to the above-noted modified or unmodified polyester resins, styrene or polymers of substitutes thereof such as polystyrene, poly-p-chlorostyrene, and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; polymethyl methacrylate, polybutylmethacrylate, polyvinyl chloride, polyvinyl acetate, polyethylene, polypropylene, polyesters, epoxy resins, epoxy polyol resins, polyurethane, polyamide, polyvinyl butyral, polyacrylic resins, rosins, modified rosins, terpene resins, aliphatic or alicyclic hydrocarbon resins, aromatic petroleum resins, chlorinated paraffin, and paraffin wax. These resins may be used alone or in combination.

The masterbatch can be prepared by mixing or kneading a colorant with the resin for use in the masterbatch through application of high shearing force. Preferably, an organic solvent may be used for improving the interactions between the colorant and the resin. Further, a so-called flashing method is preferably used, since a wet cake of the colorant can be directly used, i.e., no drying is required. Here, the flashing method is a method in which an aqueous paste containing a colorant is mixed or kneaded with a resin and an organic solvent, and then the colorant is transferred to the resin to remove the water and the organic solvent. In this mixing or kneading, for example, a high-shearing disperser, such as a three-roll mill, is preferably used.

—Releasing Agent—

The releasing agent is not particularly limited and may be appropriately selected from those known in the art depending on the intended purpose. Examples thereof include polyolefin waxes, such as polyethylene wax, polypropylene wax; long-chain hydrocarbons, such as paraffin wax, Sazole wax; and carbonyl group-containing waxes. Among these, carbonyl group-containing waxes are preferable.

Examples of the carbonyl group-containing wax include polyalkanate esters, such as carnauba wax, montan wax, trimethylolpropane tribehenate, pentaerythritol tetrabehenate, pentaerythritol diacetate dibehenate, glycerine tribehenate, and 1,18-octadecanediol distearate; polyalkanol esters, such as tristearyl trimellitate and distearyl maleate; polyalkanoic acid amides, such as ethylenediamine dibehenyl amide; polyalkyl amides, such as tristearyl trimellitate amide; and dialkyl ketones, such as distearyl ketone. Among these, polyalkanate esters are particularly preferable.

The melting point of the releasing agent is preferably 40° C. to 160° C., more preferably 50° C. to 120° C., particularly preferably 60° C. to 90° C. When the melting point is lower than 40° C., the releasing agent may adversely affect the heat-resistant storage stability of the toner. When the melting point is higher than 160° C., cold offset is easily caused upon fixing at low temperatures. In the case where the melt viscosity of the releasing agent is measured at the temperature 20° C. higher than the melting point of the releasing agent, it is preferably 5 cps to 1,000 cps, more preferably 10 cps to 100 cps. When the melt viscosity is higher than 1,000 cps, the hot offset resistance and the low temperature fixing ability may not be sufficiently improved.

The amount of the releasing agent contained in the toner is not particularly limited and may be appropriately selected depending on the intended purpose. The amount of the releasing agent in the toner is preferably 40% by mass or less, more preferably 3% by mass to 30% by mass, relative to the toner.

<Shell>

The shell contains at least the binder resin.

—Second Binder Resin—

The second binder resin is not particularly limited and may be appropriately selected depending on the intended purpose. It preferably has a different composition from that of the first binder resin, in terms of effectively exhibiting respective functions of the core and the shell. For example, since the first binder resin and the second binder resin differ in the compositions thereof, the respective functions of the core and the shell can be effectively exhibited; maintaining of the heat resistant storage stability and contamination resistance in the shell; and suitably dispersing of the colorant, releasing agent, etc, and the low temperature fixing ability in the core. Moreover, the first binder resin and the second binder resin having different compositions are preferable because it allows the toner to be designed to have a functional separation.

As a second binder resin, resin fine particles are exemplified.

The resin fine particles are not particularly limited and may be appropriately selected depending on the intended purpose. Examples thereof include vinyl resins, polyurethane resins, epoxy resins, polyester resins, polyamide resins, polyimide resins, silicon resins, phenol resins, melamine resins, urea resins, aniline resins, ionomer resins and polycarbonate resins. Among these, vinyl resins, polyurethane resins, epoxy resins, polyester resins and combinations thereof are preferable, and vinyl resins are particularly preferable, from the viewpoint of easy preparation of an aqueous dispersion liquid containing spherical resin fine particles.

The vinyl resin is a homopolymer or copolymer of a vinyl monomer. Examples thereof include styrene-(meth)acrylate ester resins, styrene-butadiene copolymers, (meth)acrylic acid-acrylate ester polymers, styrene-acrylonitrile copolymers, styrene-maleic anhydride copolymers and styrene-(meth)acrylic acid copolymers.

Moreover, as the resin fine particles, copolymers containing monomers each having at least two unsaturated groups may be used.

The monomers each having at least two unsaturated groups are not particularly limited and may be appropriately selected depending on the intended purpose. Examples thereof include sodium salt of sulfuric acid ester of ethylene oxide adduct of methacrylic acid, ELEMINOL RS-30 (manufactured by Sanyo Chemical Industries Ltd.), divinylbenzene, and 1,6-hexanediol acrylate.

The glass transition temperature Tg of the resin fine particles is not particularly limited and may be appropriately selected depending on the intended purpose. It is preferably 40° C. to 100° C. When the glass transition temperature Tg is lower than 40° C., the formed toner may have degraded storage stability, possibly causing toner blocking during storage and in a developing unit. When the glass transition temperature Tg is higher than 100° C., the resin fine particles may inhibit adhesion to fixation paper and a lower limit fixing temperature of the formed toner may be increased.

The glass transition temperature Tg of the toner is measured using TG-DSC system TAS-100 (manufactured by Rigaku Corporation) in the following manner. First, about 10 mg of a sample is placed in an aluminum-sample container, the container is mounted on a holder unit and then set in an electric oven. The sample is heated from room temperature to 150° C. at a temperature increase rate of 10° C./min, left standing at 150° C. for 10 minutes, and then cooled to room temperature and left standing for 10 minutes. The sample is heated again under a nitrogen atmosphere to 150° C. at a temperature increase rate of 10° C./min to thereby measure a DSC curve using a differential scanning calorimeter DSC. Using the analysis system in the TG-DSC system TAS-100 system, the glass transition temperature Tg is calculated from a tangent point between an endothermic curve obtained near Tg and the base line.

The weight average molecular weight of the resin fine particles is not particularly limited and may be appropriately selected depending on the intended purpose. It is preferably 3,000 to 300,000. When the weight average molecular weight is less than 3,000, the storage stability of the toner may be degraded, causing blocking during storage and in a developing unit. When the weight average molecular weight is more than 300,000, the resin fine particles may inhibit adhesion to fixation paper, and a lower limit fixing temperature of the formed toner may be increased.

The residual rate of the resin fine particles to the toner is not particularly limited and may be appropriately selected depending on the intended purpose. It is preferably 0.5% by mass to 5.0% by mass. When the residual rate is less than 0.5% by mass, the storage stability of the toner may be degraded, and blocking may occur during storage and in a developing unit. When the residual rate is more than 5.0% by mass, the resin fine particles may inhibit exudation of wax, and the effect of releasability of wax cannot be obtained, occurring offset.

The residual ratio of the resin fine particles can be measured by analyzing a substance which is not derived from toner particles but from resin fine particles using a pyrolysis gas chromatography mass spectrometer, and then calculating the residual ratio from its peak area. As a detector, a mass spectrometer is preferable, but not limited thereto.

The resin fine particles have a volume average particle diameter of preferably 120 nm to 670 nm, and more preferably 200 nm to 600 nm. When the volume average particle diameter is less than 120 nm, the thickness of the shell layer becomes thin, and the core-shell structure may not be satisfactorily formed. When the volume average particle diameter is more than 670 nm, the thickness of the shell layer becomes too thick, and the low temperature fixing ability may not be sufficiently exhibited.

The volume average particle diameter can be measured with a particle size distribution measurement device (LA-920, manufactured by HORIBA, Ltd.), or the like.

—Thickness of Shell—

The thickness of the shell is not particularly limited and may be appropriately selected depending on the intended purpose. It is preferably 0.01 μm to 2.0 μm, and more preferably 0.1 μm to 1.0 μm, particularly preferably 0.1 μm to 0.6 μm. When the thickness is less than 0.01 μm, the effect of the shell may not be sufficiently exhibited. When the thickness is more than 2.0 μm, the shell is excessively thick, causing decrease in the color developing property of a colorant in the core and in exudation of wax. Moreover, the low temperature fixing ability of the shell may not be sufficiently secured. When the thickness is within the above-described particularly preferable range, it is advantageous in terms of effectively exhibiting respective functions of the core and the shell. For example, the following respective functions of the core and the shell are effectively exhibited: maintaining of the heat resistant storage stability and contamination resistance in the shell; and suitably dispersing of the colorant, the releasing agent, etc, and the low temperature fixing ability in the core.

The shell thickness can be measured by the following method using a transmission electron microscope TEM. The shell thickness of randomly selected 10 toners are measured by the following method, and an average value thereof is defined as a shell thickness.

Firstly, approximately one spatula of a toner is embedded in an epoxy resin, and then the epoxy resin is cured to obtain a sample. The sample is cut out with a knife to reveal the cross section thereof and an ultra thin section having 200 nm-thick of the toner is prepared by an ultramicrotome (ULTRACUT UCT manufactured by Leica, with the use of a diamond knife). The cut-out sample is exposed to ruthenium tetroxide, osmium tetroxide, or other stains for 1 minute to 24 hours so as to dye a shell and a core for identification. The exposure time is appropriately adjusted depending on the contrast during the observation. And then, the ultra thin section of the toner is observed by a transmission electron microscope TEM, H7000 manufactured by Hitachi High-Technologies Corporation at an acceleration voltage of 100 kV. Depending on the compositions of a core and a shell, they can be identified without dyeing. In such a case, the sample is evaluated without dyeing. Alternatively, the contrast of the compositions can be obtained by other means such as selective etching. After such pretreatment, a sample is observed using a transmission electron microscope TEM, to thereby measure a shell thickness.

<Other Components>

Other components are not particularly limited and may be appropriately selected depending on the intended purpose. Examples thereof include a crystalline polyester resin, charge control agent, external additive, flowability improver, cleanability improver, and magnetic material. Among these, the toner preferably contains the crystalline polyester resin. The crystalline polyester resin has crystallinity, and exhibits hot melt properties that viscosity is rapidly decreased around a fixation starting temperature. That is, heat resistant storage stability of the toner is excellent immediately before a melt starting temperature, owing to the crystallinity, and the toner fixes at the melt starting temperature in which the viscosity is rapidly decreased (sharp melting properties). Therefore, the toner satisfying both excellent heat resistant storage stability and excellent low temperature fixing ability can be produced.

—Crystalline Polyester Resin—

The crystalline polyester resin means a polymer or a copolymer, obtained by polymerization of a polyester component and other components, as well as a polymer formed of 100% polyester as a constituent. However, in the case of the polymer or copolymer, obtained by polymerization of a polyester component and other components, the polymer or copolymer contains 50% or less of the other components except the polyester.

The crystalline polyester resin may be synthesized from a polycarboxylic acid component and a polyhydric alcohol component. The crystalline polyester resin may be a commercially available product, or a synthesized product.

The polycarboxylic acid components are not particularly limited and may be appropriately selected depending on the intended purpose. Examples thereof include dicarboxylic acids, and tri- or higher carboxylic acids.

Examples of the dicarboxylic acids include, but not limited to, aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid; aromatic dicarboxylic acids of dibasic acids such as phthalic acid, isophthalic acid, terephthalic acid, naphthalene-2,6-dicarboxylic acid, malonic acid, or mesaconic acid; and anhydrides and lower alkyl esters thereof.

Examples of the tri- or higher carboxylic acids include 1,2,4-benzenetricarboxylic acid, 1,2,5-benzenetricarboxylic acid, 1,2,4-naphthalenetricarboxylic acid, and anhydrides and lower alkyl esters thereof.

As the acid component, dicarboxylic acid components each having a sulfonic group may be exemplified, in addition to the aliphatic dicarboxylic acids and aromatic dicarboxylic acids. Moreover, in addition to the aliphatic dicarboxylic acids and aromatic dicarboxylic acids, dicarboxylic acid components each having double bonds may be exemplified.

These may be used alone or in combination.

The polyhydric alcohol component is not particularly limited and may be appropriately selected depending on the intended purpose. Examples thereof include diols and trihydric or higher alcohols. Examples of the diols include aliphatic diols. Examples of the aliphatic diols include linear aliphatic diols and branched aliphatic diols. Among these, linear aliphatic diols are preferable, and a linear aliphatic diol having 7 to 20 carbon atoms in a main chain is more preferable. When the branched aliphatic diol is used, the crystallinity of the crystalline polyester resin decreases and a melting point decreases. When the linear aliphatic diol having less than 7 carbon atoms in the main chain, in the case where the diol is polycondensed with aromatic dicarboxylic acid, the melting point increases, possibly causing difficulty in fixation at low temperature. On the other hand, when the linear aliphatic diol having more than 20 carbon atoms in the main chain, it may be difficult to obtain material for practical use. The number of carbon atom in the main chain is more preferably 14 or less.

Examples of the aliphatic diols include, but not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, in view of easy availability, 1,8-octanediol, 1,9-nonanediol, 1,10-decanediol are preferable.

Examples of trihydric or higher alcohols include glycerin, trimethylolethane, trimethylolpropane, and pentaerythritol.

These may be used alone or in combination.

The amount of the aliphatic diol in the polyhydric alcohol component is not particularly limited and may be appropriately selected depending on the intended purpose. It is preferably 80% by mole or more, more preferably 90% by mole or more, in the polyhydric alcohol component. When the amount is less than 80% by mole, the crystallinity of the crystalline polyester resin decreases, and a melting temperature of a toner decreases, causing decrease in toner blocking resistance, image storage stability, and low temperature fixing ability.

In order to prepare an acid value and hydroxyl value, if necessary, the polycarboxylic acid and the polyhydric alcohol may be added in the final step of a synthesis. Examples of the polycarboxylic acids include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenyl succinic anhydride, and adipic acid; alicyclic carboxylic acids such as cyclohexane dicarboxylic acid. Examples of the polyhydric alcohols include aliphatic diols, such as ethylene glycol, diethylene glycol, triethylene glycol, propylene glycol, butanediol, hexanediol, neopentylglycol, and glycerine; alicyclic diols, such as cyclohexanediol, cyclohexanedimethanol, hydrogenated bisphenol A; bisphenol A ethylene oxide adducts; and aromatic diols, such as bisphenol A propylene oxide adducts.

The acid value of the crystalline polyester resin is not particularly limited and may be appropriately selected depending on the intended purpose. It is preferably 3.0 mgKOH/g to 30.0 mgKOH/g, more preferably 6.0 mgKOH/g to 25.0 mgKOH/g, particularly preferably 8.0 mgKOH/g to 20.0 mgKOH/g. When the acid value is less than 3.0 mgKOH/g, the crystalline polyester resin is less dispersed in water, and it may be very difficult to produce particles by a wet process. Moreover, the stability of the crystalline polyester resin in the form of polymerized particles upon aggregation is significantly decreased, and it may be difficult to efficiently produce a toner. On the other hand, when the acid value is more than 30.0 mgKOH/g, the moisture absorbency of a toner increases, and the toner may be susceptible to environmental influence.

The weight average molecular weight of the crystalline polyester resin is not particularly limited and may be appropriately selected depending on the intended purpose. It is preferably 6,000 to 35,000. When the weight average molecular weight is less than 6,000, the toner may penetrate into the surface of a recording medium such as paper during fixation, causing uneven fixation, or decrease in the strength of the fixed image against bending resistance. When the weight average molecular weight is more than 35,000, the viscosity upon melting becomes so high that the temperature for achieving a viscosity suitable for fixation may increase. As a result, the low temperature fixing ability may be impaired.

The weight average molecular weight may be determined by gel permeation chromatography (GPC). The molecular weight determination by GPC is carried out using GPC-HLC-8120 as a measuring apparatus manufactured by TOSOH CORPORATION, with TSK gel Super HM-M (15 cm) as a column manufactured by TOSOH CORPORATION and THF as a solvent. The weight average molecular weight is calculated from the measurement result using a molecular weight calibration curve which has been prepared with a monodispersed polystyrene standard sample.

The amount of the crystalline polyester resin in the toner is not particularly limited and may be appropriately selected depending on the intended purpose. It is preferably 3% by mass to 40% by mass, more preferably 4% by mass to 35% by mass, particularly preferably 5% by mass to 30% by mass. When the amount is less than 3% by mass, the low temperature fixing ability may not be sufficiently obtained. When the amount is more than 40% by mass, toner strength and strength of a fixed image may not be sufficiently obtained, adversely affecting charging ability.

The melting point of the crystalline polyester resin is not particularly limited and may be appropriately selected depending on the intended purpose. It is preferably 50° C. to 100° C., more preferably 55° C. to 90° C., particularly preferably 60° C. to 85° C. When the melting point is less than 50° C., there is a difficulty in storage of a fixed image after fixation, and storage of a toner, such as blocking occurs. When the melting point is more than 100° C., the low temperature fixing ability may not be sufficiently obtained. The melting point is determined as a peak temperature of the endothermic peak measured by differential scanning calorimetry (DSC).

In the production of the crystalline polyester resin, a polymerization temperature, a decompression state and removal of fraction, and a catalyst are not particularly limited and may be appropriately selected depending on the intended purpose. The polymerization temperature is for example, 180° C. to 230° C. As to the decompression state and the removal of fraction, the pressure in the reaction system is reduced and water or alcohol generated during condensation may be removed. Examples of the catalyst include alkali metal compounds such as sodium and lithium, alkaline earth metal compounds such as magnesium and calcium, metal compounds such as zinc, manganese, antimony, titanium, tin, zirconium, germanium, or the like, phosphorous acid compounds, phosphoric acid compounds, and amine compounds.

The crystalline polyester resin may be contained in the core or shell, of the toner. It may preferably be contained in the core.

—Charge Control Agent—

The charge control agent is not particularly limited and may be appropriately selected depending on the intended purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine activator, metal salts of salicylic acid, and metal salts of salicylic acid derivatives. Specific examples thereof include nigrosine dye BONTRON 03, quaternary ammonium salt BONTRON P-51, metal azo-containing dye BONTRON S-34, oxynaphthoic acid metal complex E-82, salicylic acid metal complex E-84 and phenol condensate E-89 (manufactured by ORIENT CHEMICAL INDUSTRIES CO., LTD); quaternary ammonium salt molybdenum complex TP-302 and TP-415 (manufactured by Hodogaya Chemical Co., Ltd.); LRA-901 and boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

The amount of the charge control agent is not particularly limited and may be appropriately selected depending on the intended purpose. It is preferably 0.1 parts by mass to 10 parts by mass, more preferably 0.2 parts by mass to 5 parts by mass, relative to 100 parts by mass of the toner. When the amount is more than 10 parts by mass, toner charging ability excessively increases, causing decrease in the effect of the charge control agent, increase in electrostatic attraction force with a developing roller, and decrease in developer fluidity and image density. These charge control agent may be dissolved and dispersed after melted and kneaded with a masterbatch and resin, may be added when dissolved and dispersed directly in an organic solvent, or may be fixed on a toner surface after production of toner particles —External Additive—

As the external additive, inorganic fine particles or hydrophobized inorganic fine particles may be used in combination with oxide fine particles. The hydrophobized inorganic fine particles each have an average primary particle diameter of preferably 1 nm to 100 nm, and more preferably 5 nm to 70 nm.

The external additive preferably contains at least one type of the hydrophobized inorganic fine particles having an average primary particle diameter of 20 nm or less and at least one type of the hydrophobized inorganic fine particles having an average primary particle diameter of 30 nm or more. Moreover, the hydrophobized inorganic fine particles preferably have a BET surface area of 20 $m^2/g$ to 500 $m^2/g$.

The external additive is not particularly limited and may be appropriately selected depending on the intended purpose. Examples thereof include silica fine particles, hydrophobic silica; fatty acid metal salts such as zinc stearate and aluminum stearate; metal oxides such as titania, alumina, tin oxide and antimony oxide; and fluoropolymers.

Examples of preferable additives include hydrophobized silica, titania, titanium oxide and alumina fine particles.

Examples of the silica fine particles include R972, R974, RX200, RY200, R202, R805 and R812 (manufactured by Nippon Aerosil Co., Ltd.). Examples of the titania fine particles include P-25 (manufactured by Nippon Aerosil Co., Ltd.), STT-30, STT-65C-S (manufactured by Titanium Industries, Inc.), TAF-140 (manufactured by Fuji Titanium Industry, Co., Ltd.), MT-150W, MT-500B, MT-600B and MT-150A (manufactured by TAYCA CORPORATION).

Examples of the hydrophobized titanium oxide fine particles include P-805 (manufactured by Nippon Aerosil Co., Ltd.), STT-30A, STT-65S-S (manufactured by Titanium Industries, Inc.), TAF-500T, TAF-1500T (manufactured by Fuji Titanium Industry, Co., Ltd.), MT-100S, MT-100T (manufactured by TAYCA CORPORATION), and IT-S (manufactured by ISHIHARA SANGYO KAISHA, LTD.)

The hydrophobized oxide fine particles of silica, titania or alumina may be produced by treating the hydrophilic fine particle with silane coupling agents such as methyltrimethoxysilane, methyltriethoxysilane and octyltriethoxysilane. In addition, silicone oil-treated oxide fine particles or inorganic fine particles are suitably used, which are treated with a silicone oil by heating, if necessary.

Examples of the silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic or methacrylic-modified silicone oils, and α-methylstyrene-modified silicone oils. Examples of the inorganic fine particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. Among these, silica and titanium dioxide are preferable in particular.

The amount of the external additive is not particularly limited and may be appropriately selected depending on the intended purpose. It is preferably 0.1% by mass to 5% by mass, more preferably 0.3% by mass to 3% by mass, relative to the toner.

The average particle diameter of primary particles of the inorganic fine particles is not particularly limited and may be appropriately selected depending on the intended purpose. It is preferably 100 nm or less, more preferably 3 nm to 70 nm. In case where the diameter is less than the above-described range, the inorganic fine particles tend to be embedded into a toner to hide the effective performance; and when the diameter is larger than the range, the photoconductor surface is likely to be damaged nonuniformly.

—Flowability Improver—

The flowability improver is not particularly limited and may be appropriately selected depending on the intended purpose, as long as it is an agent for performing surface treatment to improve hydrophobic properties, and is capable of inhibiting the degradation of flowability or charging ability under high humidity environment. Specific examples of the flowability improver include silane coupling agents, silylation agents, silane coupling agents having a fluorinated alkyl group, organotitanate coupling agents, aluminum coupling agents, silicone oils, and modified silicone oils. It is preferable that the silica and titanium oxide be subjected to surface treatment with such a flowability improver and used as hydrophobic silica and hydrophobic titanium oxide.

—Cleanability Improver—

The cleanability improver is not particularly limited and may be appropriately selected depending on the intended purpose, as long as it is an agent added to the toner to remove the developer remaining on a photoconductor or a primary transfer medium after transfer. Specific examples of the cleanability improver include metal salts of fatty acids such as stearic acid including zinc stearate and calcium stearate, polymer fine particles formed by soap-free emulsion polymerization, such as polymethylmethacrylate fine particles and polystyrene fine particles. The polymer fine particles preferably have a relatively narrow particle size distribution. It is preferable that the volume average particle diameter thereof be 0.01 μm to 1 μm.

—Magnetic Material—

The magnetic material is not particularly limited and may be appropriately selected depending on the intended purpose. Examples thereof include iron powder, magnetite and ferrite. Among these, one having a white color is preferable in terms of color tone.

<Toner Shape, Etc.>

The toner of the present invention is not particularly limited in its shape, size and the like, and may be appropriately selected depending on the intended purpose. The toner preferably have an average circularity, shape factors SF-1 and SF-2, weight average particle diameter, ratio of weight average particle diameter to number average particle diameter (weight average particle diameter/number average particle diameter) and the like, which will be described below.

—Average Circularity—

The toner has an average circularity of 0.93 to 0.99, so that the core-shell structure of the toner can be secured to be in a properly substantially spherical shape.

The average circularity of the toner is defined by the following equation.

Average circularity=(Circumferential length of a circle having the same area as projected particle area/Circumferential length of projected particle image)×100(%)

The average circularity of the toner is measured using a flow-type particle image analyzer (FPIA-2100, manufactured by SYSMEX CORPORATION), and analyzed using an analysis software (FPIA-2100 Data Processing Program for FPIA Version00-10). Specifically, into a 100 mL glass beaker, 0.1 mL to 0.5 mL of a 10% by mass surfactant (NEOGEN SC-A, an alkylbenzene sulfonate, manufactured by Dai-ichi Kogyo Seiyaku Co., Ltd.) is charged, and 0.1 g to 0.5 g of a toner is added, followed by stirring with a microspatula. Subsequently, 80 mL of ion-exchanged water is added to the beaker. The obtained dispersion liquid is subjected to dispersion treatment for 3 min using an ultrasonic wave dispersing device (manufactured by Honda Electronics Co., Ltd.). Using FPIA-2100, the shape and distribution of toner particles are measured until the dispersion liquid has a concentration of 5,000 number per μL to 15,000 number per μL.

In this measuring method, it is important in terms of reproducibility in measuring the average circularity that the concentration of the dispersion liquid is adjusted to the range of 5,000 number per μL to 15,000 number per μL. To obtain the above-mentioned concentration of the dispersion liquid, it is necessary to change the conditions of the dispersion liquid, namely the amounts added of the surfactant and of the toner. The required amount of the surfactant varies depending on the hydrophobicity of the toner. When the surfactant is added in large amounts, noise is caused by foaming. When the surfactant is added in small amounts, the toner cannot be sufficiently wetted, causing insufficient dispersion. Also, the amount of the toner added varies depending on its particle diameter. When the toner has a small particle diameter, it needs to be added in small amounts. When the toner has a large particle diameter, it needs to be added in large amounts. In the case where the weight average particle diameter of the toner is 2 μm to 7 μm, the dispersion liquid concentration can be adjusted to the range of 5,000 number per μL to 15,000 number per μL by adding 0.1 g to 0.5 g of the toner.

—Shape Factor—

It is preferred that the toner preferably have a shape factor SF-1 of 100 to 150, and a shape factor SF-2 of 100 to 140, in terms that the core-shell structure of the toner can be secured in a properly substantially spherical shape.

The shape factor SF-1 and SF-2 of the toner is defined by the following method: An FE-SEM image of a toner is taken by FE-SEM (S-4200) manufactured by Hitachi High-Technologies Corporation, and 300 FE-SEM images are randomly sampled and the image information thereof are introduced into an image analyzer, LUZEX AP (manufactured by NIRECO CORPORATION) through an interface, and analyzed and calculated by the following equations. The values of SF-1 and SF-2 are preferably obtained by LUZEX. However, other than the FE-SEM device and the image analyzer, any devices can be used as long as the similar analysis results can be obtained.

$$\text{SF-1}=(L^2/A)\times(\pi/4)\times 100$$

$$\text{SF-2}=(P^2/A)\times(1/4\pi)\times 100$$

where, L represents the absolute maximum length of a toner, A represents a projected area of the toner, and P represents the maximum perimeter length of the toner. When the toner has a spherical shape, L, A, and P are 100. As a value increases from 100, the spherical shape changes to an indeterminate shape. Particularly, SF-1 represents the entire shape of a toner, i.e. ellipse, sphere or the like, and SF-2 represents a degree of irregularity of a surface of the toner.

—Weight Average Particle Diameter and Weight Average Particle Diameter/Number Average Particle Diameter—

The toner has a weight average particle diameter $D_4$ of preferably 2 μm to 7 μm, and more preferably 2 μm to 5 μm. The ratio ($D_4/D_n$) of the weight average particle diameter $D_4$ to the number average particle diameter $D_n$ is preferably 1.25 or less, and more preferably 1.15 or less. Thus, toner particles having a uniform core-shell structure can be preferably formed, in which charge developing ability, transferability, and fixing ability of the toner are secured.

The weight average particle diameter $D_4$, number average particle diameter $D_n$, and the ratio ($D_4/D_n$) of the weight average particle diameter to the number average particle diameter can be measured using Coulter Counter TA-II or COULTER MULTISIZER II (manufactured by Beckman Coulter, Inc.). In the present invention, COULTER MULTISIZER II is used. A measurement method will be described below.

First, as a dispersant, 0.1 mL to 5 mL of a surfactant (preferably, polyoxyethylene alkyl ether, nonionic surfactant) is added to 100 mL to 150 mL of an electrolytic aqueous solution. Note that the electrolytic solution is a 1% NaCl aqueous solution prepared using primary sodium chloride, for example, ISOTON-II (manufactured by Beckmann Coulter Inc.). Subsequently, 2 mg to 20 mg of a sample to be measured is further added. The electrolytic solution in which the sample is suspended is subjected to dispersion treatment for approximately 1 minute to approximately 3 minutes using an ultrasonic dispersion device. By the measurement apparatus using 100 μm-aperture, the weight and the number of toner particles or a toner are measured, and then its weight distribution and number distribution are calculated. From these distributions, the weight average particle diameter ($D_4$) and the number average particle diameter ($D_n$) of the toner are obtained.

In the measurement, the following 13 channels are used to measure particles having diameters of 2.00 μm or greater and smaller than 40.30 μm: a channel having a diameter of 2.00 μm or greater and smaller than 2.52 μm, a channel having a diameter of 2.52 μm or greater and smaller than 3.17 μm; a channel having a diameter of 3.17 μm or greater and smaller than 4.00 μm; a channel having a diameter of 4.00 μm or greater and smaller than 5.04 μm; a channel having a diameter of 5.04 μm or greater and smaller than 6.35 μm; a channel having a diameter of 6.35 μm or greater and smaller than 8.00 μm; a channel having a diameter of 8.00 μm or greater and smaller than 10.08 μm; a channel having a diameter of 10.08 μm or greater and smaller than 12.70 μm; a channel having a diameter of 12.70 μm or greater and smaller than 16.00 μm; a channel having a diameter of 16.00 μm or greater and smaller than 20.20 μm; a channel having a diameter of 20.20 μm or greater and smaller than 25.40 μm; a channel having a diameter of 25.40 μm or greater and smaller than 32.00 μm; and a channel having a diameter of 32.00 μm or greater and smaller than 40.30 μm.

The toner is preferably produced by dispersing or emulsifying in an aqueous medium any of an oil phase and a monomer phase, which contain any of a toner composition and a toner composition precursor. Thus, a toner having a core-shell structure is formed, and the toner having appropriate softening properties inside the shell and core can be formed.

Normally, the materials for forming a core, for example, the first binder resin, the colorant, and the releasing agent, are contained in any of the oil phase and the monomer phase, and the materials for forming a shell, for example, the second binder resin are contained in the aqueous medium.

The toner is preferably formed by subjecting the toner composition which contains at least a polymer having a site reactive with an active hydrogen group-containing compound, a polyester resin, a colorant and a releasing agent to a crosslinking and/or elongation reaction in an aqueous medium in the presence of resin fine particles. Thus, a toner having a core-shell structure is formed, and the toner having appropriate softening properties inside the shell and core can be formed.

<Method for Producing Toner>

A method for producing a toner is not particularly limited and may be appropriately selected depending on the intended purpose.

For example, a toner can be produced by subjecting a toner composition containing at least a polymer having a site reactive with an active hydrogen group-containing compound, a polyester resin, a colorant and a releasing agent to a crosslinking and/or elongation reaction in an aqueous medium in the presence of resin fine particles.

Specifically, polyol (1) and polycarboxylic acid (2) are heated at 150° C. to 280° C. in the presence of an esterified catalyst such as tetrabutoxy titanate, and dibutyltin oxide, and water is distilled away, if necessary by reducing pressure, to thereby obtain a hydroxyl group-containing polyester. Next, polyisocyanate (3) is reacted at 40° C. to 140° C. to produce the isocyanate group-containing polyester prepolymer (A).

An aqueous medium is used by adding the fine resin particles therein in advance. Water used in the aqueous medium may be used alone, or a solvent miscible in water may be used in combination with water. Examples of the solvent miscible in water include alcohols such as methanol, isopropanol, ethylene glycol, etc., dimethylformamide, tetrahydrofuran, cellosolves such as methyl cellosolve, etc. and lower ketones such as acetone, methyl ethyl ketone, etc.

The amount of the fine resin particles in the aqueous medium is not particularly limited and may be appropriately selected depending on the intended purpose. For example, it is preferably 0.5% by mass to 10% by mass.

The toner may be formed by reacting the amines (B) with a dispersion obtained by dissolving or dispersing the isocyanate group-containing polyester prepolymer (A) in an organic solvent in an aqueous medium. An exemplary method of stably forming the dispersion of the polyester prepolymer (A) in the aqueous medium is a method in which a toner material composition obtained by dissolving or dispersing the polyester prepolymer (A) in an organic solvent is added to the aqueous medium, followed by dispersing the mixture by a shearing force. The polyester prepolymer (A) dissolved or dispersed in the organic solvent and additional toner composition (hereinafter also referred to as "toner material") such as a colorant, a colorant master batch, a releasing agent, a charge control agent, an unmodified polyester resin and the like may be mixed together in the aqueous medium to form a dispersion, but it is preferable that the toner material be mixed beforehand and dissolved or dispersed in an organic solvent, and then the mixture be added and dispersed in the aqueous medium. The additional toner material such as a colorant, a releasing agent, and a charge control agent are not necessarily mixed when particles are formed in the aqueous medium, and such material may be added after particles are formed. For example, after particles containing no colorant are formed, a colorant can be added by a conventionally known dyeing method.

The dispersing method is not particularly limited and may be appropriately selected depending on the intended purpose. Known devices using low-speed shearing mode, high-speed shearing mode, frictional mode, high-pressure jet mode, ultrasonic mode or the like can be used. In order to make the dispersion have a dispersed particle diameter of 2 μm to 20 μm, it is preferable to employ a high-speed shearing mode. When a high-speed shearing dispersing device is used, the number of revolutions is not particularly limited, but it is usually 1,000 rpm to 30,000 rpm, and preferably 5,000 rpm to 20,000 rpm. The dispersion time is not particularly limited, but when a batch mode is employed, it is usually 0.1 minutes to 5 minutes. The temperature of the system during the dispersion is usually 0° C. to 150° C. (under pressurization) and preferably 40° C. to 98° C. Within the temperature range, a higher temperature is preferable in that the dispersion of the polyester prepolymer (A) has low viscosity, and is easily dispersed.

The amount of the aqueous medium is preferably 50 parts by mass to 2,000 parts by mass, more preferably 100 parts by mass to 1,000 parts by mass, relative to 100 parts by mass of the toner composition containing the polyester prepolymer (A).

When the amount of the aqueous medium is less than 50 parts by mass, the toner composition is not sufficiently dispersed, and toner particles having predetermined particle diameter may not be obtained. When the amount is more than 2,000 parts by mass, it is economically disadvantageous. Further, a dispersant may be used if necessary. It is preferable to use a dispersant in that the particle size distribution becomes sharp and the dispersed state is stable.

The dispersant is not particularly limited and may be appropriately selected depending on the intended purpose. Examples thereof include surfactants, dispersants composed of an inorganic compound sparingly soluble in water, polymer protective colloids. These may be used alone or in combination. Among these, surfactants are preferable.

Examples of the surfactants include anionic surfactants, cationic surfactants, nonionic surfactants and amphoteric surfactants.

Examples of anionic surfactants include alkylbenzene sulfonic acid salts, α-olefin sulfonic acid salts, phosphates, and anionic surfactants having a fluoroalkyl group. Of these, the anionic surfactants having a fluoroalkyl group are preferable. Examples of the anionic surfactants having a fluoroalkyl group include fluoroalkyl carboxylic acids having 2 to 10 carbon atoms or metal salts thereof, disodium perfluorooctanesulfonylglutamate, sodium-3-[ω-fluoroalkyl (C6 to C11) oxy]-1-alkyl (C3 to C4) sulfonate, sodium-3-[ω-fluoroalkanoyl (C6 to C8)-N-ethylamino]-1-propanesulfonate, fluoroalkyl (C11 to C20) carboxylic acids or metal salts thereof, perfluoroalkyl (C7 to C13) carboxylic acids or metal salts thereof, perfluoroalkyl (C4 to C12) sulfonic acid or metal salts thereof, perfluorooctanesulfonic acid diethanol amide, N-propyl-N-(2-hydroxyethyl)perfluorooctanesulfone amide, perfluoroalkyl (C6 to C10) sulfoneamidepropyltrimethylammonium salts, perfluoroalkyl (C6 to C10)-N-ethylsulfonyl glycin salts, and monoperfluoroalkyl (C6 to C16) ethylphosphate ester. Examples of commercially available products of the fluoroalkyl group-containing anionic surfactants include, but not limited to, SURFLON S-111, S-112 and S-113 (manufactured by Asahi Glass Co., Ltd.); FLUORAD FC-93, FC-95, FC-98 and FC-129 (manufactured by Sumitomo 3M Limited); UNIDYNE DS-101 and DS-102 (manufactured by Daikin Industries, Ltd.); MEGAFACE F-110, F-120, F-113, F-191, F-812 and F-833 (manufactured by DIC Corporation); EETOP EF-102, 103, 104, 105, 112, 123A, 123B, 306A, 501, 201 and 204 (manufactured by Tohchem Products Co., Ltd.); and FTERGENT F-100 and F-150 (manufactured by NEOS COMPANY LIMITED).

Examples of the cationic surfactants include amine salts, quaternary ammonium salts, and cationic surfactants having a fluoroalkyl group. Examples of the amine salts include alkyl amine salts, amino alcohol fatty acid derivatives, polyamine fatty acid derivatives, and imidazoline. Examples of the quaternary ammonium salts include alkyltrimethyl ammonium salts, dialkyldimethyl ammonium salts, alkyldimethyl benzyl ammonium salts, pyridinium salts, alkyl isoquinolinium salts, and benzethonium chloride. Examples of the cationic surfactants having a fluoroalkyl group include primary, secondary and tertiary aliphatic amine acids having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, and imidazolinium salts.

Examples of commercially available products of the cationic surfactants include SURFLON S-121 (manufactured by Asahi Glass Co., Ltd.), FLUORAD FC-135 (manufactured by Sumitomo 3M Limited), UNIDYNE DS-202 (manufactured by Daikin Industries, Ltd.), MEGAFACE F-150 and F-824 (manufactured by DIC Corporation), EFTOP EF-132 (manufactured by Tohchem Products Co., Ltd.), and FTERGENT F-300 (manufactured by NEOS COMPANY LIMITED).

Examples of the nonionic surfactants include fatty acid amide derivatives, and polyhydric alcohol derivatives.

Examples of the ampholytic surfactants include alanine, dodecyldi(aminoethyl)glycine, di(octylaminoethyl)glycine, and N-alkyl-N,N-dimethyl ammonium betaine.

Examples of the inorganic compound dispersants having sparing water solubility include tricalcium phosphate, calcium carbonate, titanium oxide, colloidal silica, and hydroxyapatite.

Examples of the polymer protective colloids include acids, hydroxyl group-containing (meth)acrylic monomers, vinyl alcohols or ethers of vinyl alcohols, esters of vinyl alcohol and carboxyl group-containing compounds, amide compounds or methylol compounds thereof, chlorides, homopolymers or copolymers of a compound containing a nitrogen atom or a nitrogen-containing heterocyclic ring, polyoxyethylene, and celluloses.

Examples of the acids include acrylic acid, methacrylic acid, α-cyanoacrylic acid, α-cyanomethacrylic acid, itaconic acid, crotonic acid, fumaric acid, maleic acid, and maleic anhydride. Examples of the hydroxyl group-containing (meth)acrylic monomers include β-hydroxyethyl acrylate, β-hydroxylethyl methacrylate, β-hydroxylpropyl acrylate, β-hydroxylpropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide, and N-methylolmethacrylamide. Examples of the vinyl alcohols or ethers of vinyl alcohols include vinyl methyl ether, vinyl ethyl ether, and vinyl propyl ether. Examples of the esters of vinyl alcohols and carboxyl group-containing compounds include vinyl acetate, vinyl propionate, and vinyl butyrate. Examples of the amide compounds or methylol compounds thereof include acryl amide, methacryl amide, diacetone acryl amide acid, and methylol compounds thereof. Examples of the chlorides include acrylic acid chloride, and methacrylic acid chloride. Examples of the homopolymers or copolymers of a compound containing a nitrogen atom or a nitrogen-containing heterocyclic ring include vinyl pyridine, vinyl pyrrolidone, vinyl imidazole, and ethylene imine. Examples of the polyoxy ethylenes include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester. Examples of the celluloses include methyl cellulose, hydroxyethyl cellulose, and hydroxypropyl cellulose.

In preparation of the dispersion, a dispersion stabilizer may be used if necessary.

Examples of the dispersion stabilizers include those soluble in acid and alkali, such as calcium phosphate.

When a dispersion stabilizer, e.g., calcium phosphate, soluble in an acid or alkalis is used, the calcium phosphate can be removed from fine particles by dissolving it with an acid such as hydrochloric acid, followed by washing with water; or by enzymatically decomposing it.

In preparation of the dispersion, catalysts for the elongation reaction and/or the cross-linking reaction may be used. Examples of the catalysts include dibutyltin laurate and dioctyltin laurate.

The organic solvent is removed from the resultant dispersion liquid (emulsified slurry). The method for removing the organic solvent is performed as follows: (1) the entire reaction system is gradually increased in temperature to completely evaporate the organic solvent contained in oil droplets; or (2) the emulsified dispersion is sprayed in a dry atmosphere to completely remove and evaporate the water insoluble organic solvent contained in oil droplets together with the aqueous dispersant, whereby toner fine particles are formed.

By removing the organic solvent, toner particles are formed. The thus-formed toner particles are subjected to washing, drying, etc., and then, if necessary, to classification, etc. Classification is performed by removing very fine particles using a cyclone, a decanter, a centrifugal separator, etc. in a liquid. Alternatively, after drying, the formed powdery toner particles may be classified.

Subsequently, a maturing step is preferably performed in order to control hollow state inside the toner, at a temperature of preferably 30° C. to 55° C., and more preferably 40° C. to 50° C. A maturing time is preferably for 5 hours to 36 hours and more preferably for 10 hours to 24 hours.

When the particle size distribution is widened in the emulsification-dispersion process, and the system is washed and dried with keeping the particle size distribution, and the particle size distribution can be controlled by classifying into a desired particle size distribution.

The classification is performed in a liquid by removing fine particle parts with a cyclone, decanter, and centrifugal separator. The classification operation may be performed after a toner is obtained as a powder by drying, but preferably performed in a liquid in terms of efficiency.

The toner particles produced through the above-described steps may be mixed with, for example, the colorant, the releasing agent and the charge control agent, or a mechanical impact may be applied to the mixture (toner particles) for preventing particles of the releasing agent, etc. from dropping off from the surfaces of the toner particles.

Examples of the method for applying a mechanical impact include a method in which an impact is applied to a mixture using a high-speed rotating blade, and a method in which impact is applied by putting mixed particles into a high-speed air flow and accelerating the air speed such that the particles collide with one another or that the particles are crashed into a proper collision plate. Examples of apparatuses used in these methods include ANGMILL (manufactured by Hosokawa Micron Corporation), an apparatus produced by modifying I-type mill (manufactured by Nippon Pneumatic Mfg. Co., Ltd.) so that the pulverizing air pressure thereof is decreased, a hybridization system (manufactured by Nara Machinery Co., Ltd.), a kryptron system (manufactured by Kawasaki Heavy Industries, Ltd.), and an automatic mortar.

(Two-Component Developer)

A two-component developer of the present invention contains at least the toner, and a carrier having magnetic properties, and if necessary further contains other components.

The two-component developer is advantageous in that carrier spent does not easily occur at high temperature and high humidity.

The two-component developer is preferred in terms of long life when it is used in high-speed printers that meet the needs of improvement of information processing speed in recent years.

In the case of the two-component developer using the toner of the present invention, even though toner consumption and toner supply have been repeated for a long time, the variation of toner particle diameters in the developer is small, and even after a long time stirring in a developing unit, excellent and stable developing ability can be ensured.

<Carrier>

The carrier is not particularly limited and may be appropriately selected depending on the intended purpose. The carrier preferably contains a core material and a resin layer coating the core material.

—Core Material—

The material of the core material is not particularly limited and may be appropriately selected depending on the intended purpose. For example, manganese-strontium (Mn—Sr) materials, and manganese-magnesium (Mn—Mg) materials (50 emu/g to 90 emu/g) are preferably employed. Further, high magnetization materials such as iron powder (100 emu/g or more), and magnetite (75 emu/g to 120 emu/g) are preferably employed, for the purpose of securing image density. Moreover, low magnetization materials such as copper-zinc (Cu—Zn) with 30 emu/g to 80 emu/g are preferably employed because the impact toward a latent electrostatic image bearing member, on which toner particles are held in upright positions, can be relieved and because it is advantageous for improving image quality. These may be used alone or in combination.

A particle diameter of the core material is not particularly limited and may be appropriately selected depending on the intended purpose. It is preferably 10 μm to 200 μm, and more preferably 40 μm to 100 μm in terms of the average particle diameter (weight average particle diameter ($D_{50}$)).

When the average particle diameter (weight average particle diameter ($D_{50}$) is smaller than 10 μm, it may sometimes cause carrier scattering due to an increase in the amount of fine particles in the carrier particle distribution and the reduced magnetization per particle. When it is greater than 200 μm, a specific surface area decreases and toner scattering may occur, and in the case of a full-color image with a large area of solid part, in particular, the reproducibility of the solid part may sometimes degrade.

—Resin Layer—

The material of the resin layer is not particularly limited and may be appropriately selected depending on the intended purpose. Examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomer, copolymers of vinylidene fluoride and vinyl fluoride, fluoroterpolymers such as terpolymers of tetrafluoroethylene, vinylidene fluoride and monomer having no fluorine-containing group, and silicone resins. These may be used alone or in combination.

Examples of the amino resins include urea-formaldehyde resins, melamine resins, benzoguanamine resins, urea resins, polyamide resins, and epoxy resins. Examples of the polyvinyl resins include acrylic resins, polymethylmethacrylate resins, polyacrylonitirile resins, polyvinyl acetate resins, polyvinyl alcohol resins, polyvinyl butyral resins. Examples of the polystyrene resins include polystyrene resins and styrene-acrylic copolymer resins. Examples of the halogenated olefin resins include polyvinyl chloride resins. Examples of the polyester resins include polyethyleneterephthalate resins and polybutyleneterephthalate resins.

In the resin layer conductive powder may be contained, if necessary. Examples of the conductive powder include metal powder, carbon black, titanium oxide, tin oxide, and zinc oxide. The average particle diameter of the conductive powder is not particularly limited and may be appropriately selected depending on the intended purpose. It is preferably 1 μm or less. When the average particle diameter is greater than 1 μm, it may be difficult to control an electrical resistance.

The resin layer may be formed by uniformly coating a surface of the core material with a coating solution obtained by dissolving the silicone resin or the like in a solvent, by a known coating method, followed by drying and baking. The coating method is not particularly limited and may be appropriately selected depending on the intended purpose. Examples thereof include dipping, spraying, and brushing.

The solvent is not particularly limited and may be appropriately selected depending on the intended purpose. Examples thereof include toluene, xylene, methyl ethyl ketone, methyl isobutyl ketone, cellosolve, and butyl acetate.

The baking method is not particularly limited and may be appropriately selected depending on the intended purpose. It may be external heating or internal heating.

A baking device is not particularly limited and may be appropriately selected depending on the intended purpose. Examples thereof include a fixed electric furnace, a fluid electric furnace, a rotary electric furnace, a burner furnace, and a device using microwave.

The amount of the resin layer in the carrier is preferably 0.01% by mass to 5.0% by mass. When the amount is less than 0.01% by mass, the resin layer may not be uniformly formed over the surface of the core material. When the amount is more than 5.0% by mass, the resin layer becomes so thick that fusing of carrier particles occurs and thus equally-sized carrier particles may not be obtained.

The amount of the carrier contained in the two-component developer is not particularly limited and may be appropriately selected depending on the intended purpose. The amount of the carrier is preferably 90% by mass to 98% by mass, more preferably 93% by mass to 97% by mass.

In the case of the two-component developer, the mixing proportion of the toner in the carrier is preferably 1 part by mass to 10.0 parts by mass of the toner relative to 100 parts by mass of the carrier.

The two-component developer of the present invention includes the toner, thus, it has excellent low temperature fixing ability at high temperature and high humidity, and can prevent carrier spent.

The two-component developer of the present invention can suitably used for image formation by known electrophotography, and can particularly preferably used for a process cartridge, color image forming apparatus of the present invention, which will be described below.

(Process Cartridge)

The process cartridge of the present invention includes at least a latent electrostatic image bearing member (also referred to as "photoconductive insulator", "electrographic photoconductor', and "photoconductor"), and a developing unit configured to develop a latent electrostatic image formed on the latent electrostatic image bearing member using a toner so as to form a visible image, and further includes other units, if necessary.

The developing unit includes at least a developer container containing therein the toner and/or the two-component developer of the present invention, and a developer bearing member configured to bear and deliver the toner and/or the two-component developer contained in the developer container, and may further include a layer thickness regulation member configured to regulate a layer thickness of the toner to be born.

The process cartridge can be detachably attached onto various electrophotographic image forming apparatuses, and preferably may be detachably attached onto the color image forming apparatus used in the present invention as described below.

Figure 2:
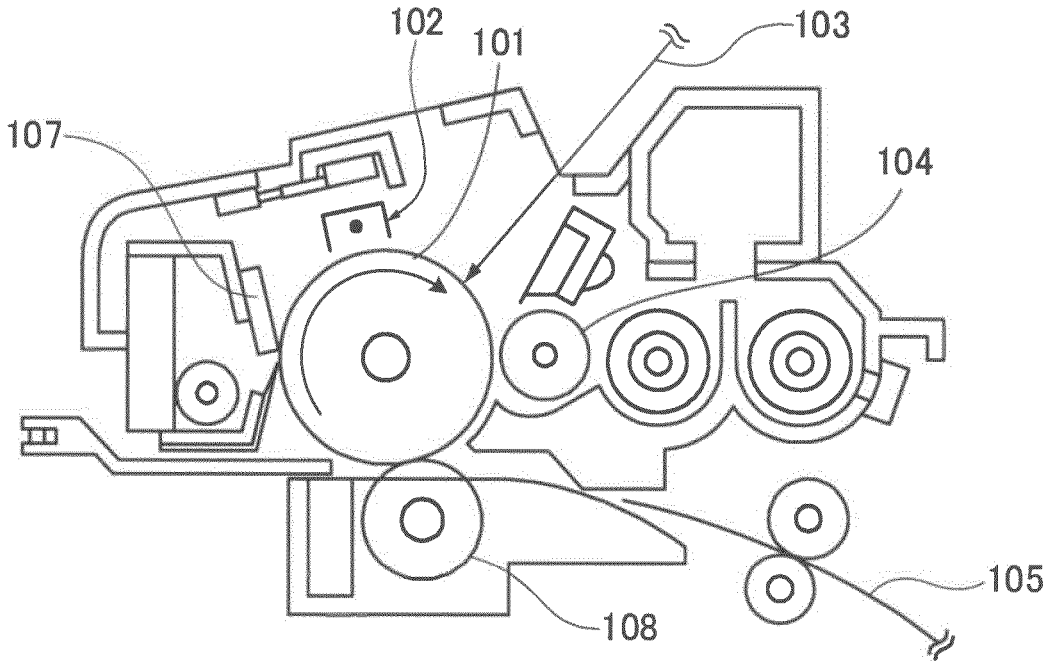
FIG. 2 shows a schematic configuration of an example of a process cartridge of the present invention.

Here, the process cartridge, for example, as shown in FIG. 2, includes therein a photoconductor 101, and further includes at least one of a charging unit 102, a developing unit 104, a transferring unit 108, a cleaning unit 107, and a charge eliminating unit (not shown), and is an apparatus (component) which can be detachably attached onto a main body of an image forming apparatus.

The image forming process using the process cartridge shown in FIG. 2 is described. While the photoconductor 101 is rotated in a direction indicated by an arrow in FIG. 2, a latent electrostatic image corresponding to an exposure image formed on the surface thereof by a charging unit 102 and exposure 103 provided by an exposure unit (not shown). The latent electrostatic image is developed with a toner by the developing unit 104, and the developed toner image is transferred to a recording medium 105 by means of the transferring unit 108, and printed out. Subsequently, the photoconductor surface on which an image has been transferred is cleaned by the cleaning unit 107, and electrical charges are removed by a charge eliminating unit (not shown). Then, these operations are repeated.

(Color Image Forming Apparatus)

The color image forming apparatus of the present invention includes at least a latent electrostatic image bearing member, a latent electrostatic image forming unit, a developing unit, a transferring unit, and a fixing unit, and if necessary, further includes other units.

The color image forming apparatus employs a tandem developing system in which different developing units for at least four developing colors are arranged in tandem, wherein a linear velocity of the system is 500 mm/sec to 2,500 mm/sec, and a surface pressure of the fixing member is 10 $N/cm^2$ to 150 $N/cm^2$. Thus, fixation at a low temperature in high speed printing can be achieved, so that an image having sufficient solid fixing strength can be obtained even when the heat amount for fixation is not sufficiently provided.

<Latent Electrostatic Image Bearing Member>

The material, shape, structure, and size of the latent image bearing member is not particularly limited and may be appropriately selected depending on the intended purpose.

For example, the shape is a drum shape.

Examples of the materials include inorganic photoconductors such as amorphous silicon and selenium, and organic photoconductors such as polysilane and phthalopolymethine. Among these, amorphous silicon is preferable in terms of long lifetime.

As to the amorphous silicon photoconductor, it is possible to use a photoconductor having a photoconductive layer composed of a-Si (also referred to as an "a-Si photoconductor"), obtained by heating a support to 50° C. to 400° C. and making the layer on the support by a film deposition method such as a vacuum deposition method, a spattering method, an ion-plating method, a thermal CVD method, an optical CVD method and a plasma CVD method. Among these, the plasma CVD method, i.e. the method in which a source gas is decomposed by direct current, high frequency or microwave glow discharge to form an a-Si deposition film on the support, is preferable.

<Latent Electrostatic Image Forming Unit>

The latent electrostatic image forming unit is a unit configured to form a latent electrostatic image on the latent electrostatic image bearing member.

The latent electrostatic image forming unit includes at least a charging unit configured to uniformly charge a surface of the latent electrostatic image bearing member, and an exposing unit configured to expose imagewise the surface of the latent electrostatic image bearing member.

The formation of the latent electrostatic image is carried out by, for example, exposing the latent electrostatic image bearing member imagewise after uniformly charging its entire surface.

The charging is carried out by, for example, applying voltage to the surface of the latent electrostatic image bearing member using the charging unit.

The charging unit is not particularly limited and may be appropriately selected depending on the intended purpose. Examples thereof include known contact-chargers equipped with a conductive or semiconductive roller, brush, film or rubber blade, and known non-contact-chargers utilizing corona discharge such as corotron or scorotoron.

A charging member may be formed into any form, such as a magnetic brush, a fur brush, or the like, in addition to a roller. These charging members may be selected depending on the specification or form of electrophotographic apparatuses. In the case of using a magnetic brush, the magnetic brush uses various ferrite particles, for example, Zn—Cu ferrites as a charging member, and is constructed of a non-magnetic conductive sleeve for supporting these ferrite particles, and a magnet roll included therein. Alternatively, in the case of using a brush, a fur which has been processed to be conductive with carbon, copper sulfide, a metal, or a metal oxide is used as a material of a fur brush, and this fur is wound or attached to metals or other cores which have been processed to be conductive, so as to form a charger.

Although the charging unit is not limited to the above-described contact-charger, an image forming apparatus in which ozone generated from the charging unit is reduced can be obtained, so that a contact-charger is preferably used.

The exposure may be carried out by exposing the surface of the latent electrostatic image bearing member imagewise using of the exposing unit.

The exposing unit is not particularly limited and may be appropriately selected depending on the intended purpose, as long as it is capable of exposing imagewise on the surface of the electrophotographic photoconductor which has been charged by the charging unit. Examples thereof include various exposing units such as a copying optical system, a rod lens array system, a laser optical system, and a liquid crystal shutter optical system.

Here, in the present invention, a backlight system for exposing the latent electrostatic image bearing member imagewise from the rear surface side may be employed.

<Developing Unit>

The developing unit is a unit configured to develop the latent electrostatic image using the toner and/or the two-component developer so as to form a visible image.

The visible image may be formed by developing the latent electrostatic image using the toner and/or the two-component developer.

The developing unit is not particularly limited and may be appropriately selected depending on the intended purpose, as long as it is capable of developing an image using the toner and/or the two-component developer. For example, a developing unit that includes at least a developing device that contains the toner and/or the two-component developer and is capable of supplying the toner and/or the two-component developer to the latent electrostatic image in a contact or noncontact manner is preferable. Moreover, a developing device includes a toner container is more preferable.

The developing device may employ either a dry developing system or a wet developing system, and may be either a single-color developing device or a multi-color developing device. Examples thereof include one including a stirrer that frictionally stirs the toner and/or the two-component developer so as to be charged and a rotatable magnet roller.

In the developing device, for example, the toner and the carrier are mixed and stirred, the toner is charged by friction upon stirring and is held in an upright position on the surface of the rotating magnet roller to form a magnetic brush. Since the magnet roller is arranged in the vicinity of the latent electrostatic image bearing member (photoconductor), a part of the toner constituting the magnetic brush formed on the surface of the magnet roller is moved to the surface of the latent electrostatic image bearing member by an electrical suction force. As a result, the latent electrostatic image is developed with the toner to form a visible image on the surface of the latent electrostatic image bearing member (photoconductor).

The developer contained in the developing device is a developer containing the toner. The developer may be a one-component developer or a two-component developer. A toner contained in the developer is the above-described toner.

<Transferring Unit>

The transferring unit is not particularly limited and may be appropriately selected depending on the intended purpose, as long as the visible image is transferred onto a recording medium. The transferring unit is preferably configured to primarily transfer a visible image onto an intermediate transfer medium, and to secondarily transfer the visible image from the intermediate transfer medium to the recording medium. It is more preferred that toners of two or more colors, preferably full-color toners be employed, and that the transferring unit include a primary transferring unit configured to transfer the toner images onto the intermediate transfer medium so as to form a composite toner image and a secondary transferring unit configured to transfer the composite toner image from the intermediate transfer medium to the recording medium.

The transferring is performed is performed by the transferring unit, for example, the visible image is transferred by charging the latent electrostatic image bearing member (photoconductor) using a transfer-charger. In a preferred embodiment, the transferring unit includes a primary transferring unit configured to transfer the visible image onto the intermediate transfer medium to form a composite transfer image, and a secondary transferring unit configured to transfer the composite transfer image onto the recording medium.

The intermediate transfer medium is not particularly limited and may be appropriately selected from known transfer media depending on the intended purpose, and examples thereof include a transfer belt.

The stationary friction coefficient of the intermediate transfer medium is preferably 0.1 to 0.6, and more preferably 0.3 to 0.5. The volume resistance of intermediate transfer medium is preferably several Ω·cm to $10^3$ Ω·cm. The volume resistance within the range of several Ω·cm to $10^3$ Ω·cm may prevent charging of the intermediate transfer medium itself, and the charge applied by a charge application unit is unlikely to remain on the intermediate transfer medium, therefore, transfer nonuniformity at the secondarily transferring may be prevented and the application of transfer bias at the secondarily transferring is easily performed.

Materials used for the intermediate transfer medium are not particularly limited and may be appropriately selected depending on the intended purpose.

Examples of the materials include the followings: (1) materials with high Young's modulus (tension elasticity) used as a single layer belt such as polycarbonates (PC), polyvinylidene fluoride (PVDF), polyalkylene terephthalate (PAT), blend materials of PC/PAT, blend materials of ethylene tetrafluoroethylene copolymer (ETFE) and PC, blend materials of ETFE and PAT, blend materials of PC and PAT, and thermosetting polyimides of carbon black dispersion. These single layer belts having high Young's modulus are small in their deformation against stress during image formation and are particularly advantageous in that registration error is less likely to occur during color image formation; (2) a double or triple layer belt using the belt having high Young's modulus as described in (1) as a base layer, on which outer periphery a surface layer and an optional intermediate layer are formed. The double or triple layer belt has a capability of preventing print defect of unclear center portion in a line image that is caused by hardness of the single layer belt; and (3) an elastic belt incorporating a resin, a rubber or an elastomer with relatively low Young's modulus. This belt is advantageous in that there is almost no print defect of unclear center portion in a line image owing to its softness. Additionally, by making width of the belt wider than drive roller or tension roller and thereby using the elasticity of edge portions that extend over the rollers, it can prevent meandering of the belt. It is also cost effective for requiring neither ribs nor units for prevention of meandering.

Conventionally, for transfer belts, fluorine resins, polycarbonates, polyimides, and the like have been used, but in the recent years, elastic belts in which elastic members are used in all layers or a part thereof. There are the following problems in transfer of color images using a resin belt.

Color images are typically formed by four colors toners. In one color image, toner layer(s) consisting of one layer to four layers are formed. Toner layers are pressurized as they pass through the primary transfer in which the layers are transferred from the photoconductor to the intermediate transfer belt and the secondary transfer in which the toner layers are transferred from the intermediate transfer belt to the sheet, which increases the cohesive force among toner particles. As the cohesive force increases, phenomena such as dropouts of letters and dropouts of edges of solid images are likely to occur. Since resin belts are excessively hard and not deformed according to the toner layers, they tend to compress the toner layers and therefore dropout of letters are likely to occur.

Recently, the demand for printing full-color images on various types of paper such as Japanese paper and paper having a rough surface is increasing. However, sheets of paper having low smoothness tend to form air gaps between the toner and the sheet upon transfer and thus causing defective transfers. When the transfer pressure of a secondary transfer section is raised in order to improve adhesiveness, the cohesive force of the toner layers will be higher, which will cause dropout of letters as described above.

Elastic belts are used for the following purpose. The elastic belt deforms corresponding to a toner layer and a recording medium having poor smoothness in the transfer section. In other words, since elastic belts deform complying with local roughness and an appropriate adhesiveness can be obtained without excessively increasing the transfer pressure against the toner layer, it is possible to obtain transfer images having excellent uniformity with no void in characters even on a recording medium having poor smoothness.

Examples of the resins used for the elastic belt include, but not limited to, polycarbonate resins, fluorine resins (such as ETFE and PVDF); polystyrenes, chloropolystyrenes, poly-α-methylstyrenes; styrene resins (homopolymers or copolymers containing styrene or styrene substituents) such as styrene-butadiene copolymers, styrene-vinyl chloride copolymers, styrene-vinyl acetate copolymers, styrene-maleic acid copolymers, styrene-acrylate copolymers such as styrene-methyl acrylate copolymers, styrene-ethyl acrylate copolymers, styrene-butyl acrylate copolymers, styrene-octyl acrylate copolymers, and styrene-phenyl acrylate copolymers; styrene-methacrylate copolymers such as styrene-methyl methacrylate copolymers, styrene-ethyl methacrylate copolymers and styrene-phenyl methacrylate copolymers; styrene-α-chloromethyl acrylate copolymers, styrene-acrylonitrile acrylate copolymers, methyl methacrylate resins, and butyl methacrylate resins; ethyl acrylate resins, butyl acrylate resins, modified acrylic resins such as silicone-modified acrylic resins, vinyl chloride resin-modified acrylic resins and acrylic urethane resins; vinyl chloride resins, styrene-vinyl acetate copolymers, vinyl chloride-vinyl acetate copolymers, rosin-modified maleic acid resins, phenol resins, epoxy resins, polyester resins, polyester polyurethane resin, polyethylene resins, polypropylene resins, polybutadiene resins, polyvinylidene chloride resins, ionomer resins, polyurethane resins, silicone resins, ketone resins, ethylene-ethylacrylate copolymers, xylene resins, polyvinylbutylal resins, polyamide resins and modified polyphenylene oxide resins. These resins may be used alone or in combination. Moreover, examples of the resins used for the elastic belt include rubbers of the elastic materials and elastomers.

The rubbers of the elastic materials and elastomers are not particularly limited and may be appropriately selected depending on the intended purpose. Examples thereof include butyl rubber, acrylic rubber, ethylene propylene rubber (EPDM), acrylonitrilebutadiene rubber (NBR), acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, fluorine rubber, polysulfurized rubber, polynorbornen rubber, hydrogenated nitrile rubber, thermoplastic elastomers such as polystyrene elastomers, polyolefin elastomers, polyvinyl chloride elastomers, polyurethane elastomers, polyamide elastomers, polyurea elastomers, polyester elastomers and fluorine resin elastomers. These may be used alone or in combination.

A method for preventing the elastic belt from elongating is not particularly limited and may be appropriately selected depending on the intended purpose. Examples thereof include a method in which a rubber layer is formed on a core resin layer which is less stretchable; and a method in which materials that prevent elongation are added to a core layer.

The material for forming the core layer, which prevents stretch is not particularly limited and may be appropriately selected depending on the intended purpose. Examples thereof include natural fibers such as cotton, and silk; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, and phenol fibers; inorganic fibers such as carbon fibers, glass fibers, and boron fibers; metal fibers such as iron fibers, and copper fibers. Additionally, these materials that are in the form of a woven cloth or thread may also be used.

The thread may be one filament or twisted filaments, single twist yarn, plied yarn, two folded yarn, or those made by any method. Alternatively, a fiber made of one selected from the above-described materials may be blended. A thread which is subjected to proper conductive treatment may be used. On the other hand, the woven cloth by means of any texture such as tricot weave can be used. A union fabric may be possibly used and can be naturally subjected to conductive treatment.

The method for forming the core layer is not particularly limited and may be appropriately selected depending on the intended purpose. Examples thereof include a method in which a woven cloth that is woven in a cylindrical shape is placed on a mold or the like and a coating layer is formed on top of it a method in which a woven cloth that is woven in a cylindrical shape is dipped in a liquid rubber or the like so that coating layer(s) are formed on one side or on both sides of the core layer; and a method in which a thread is twisted helically around a mold or the like with an arbitrary pitch, and then a coating layer is formed thereon.

The thickness of the elastic layer depends on the hardness of the elastic layer. As the coated layer comes to thicker, elongation and contraction of the surface becomes more significant and the surface layer tends to form cracks, causing significant elongation and contraction of images, therefore, excessive thickness such as about 1 mm or more is undesirable.

The transferring unit, i.e. the primary transferring unit and the secondary transferring unit, preferably includes at least a transferring device configured to charge so as to separate the visible image formed on the latent electrostatic image bearing member and transfer the visible image onto the recording medium. One transferring unit or two transferring units may be used. Examples of the transferring devices include corona transferers utilizing corona discharge, transfer belts, transfer rollers, pressure-transfer rollers, and adhesion-transferers.

A typical recording medium is plain paper, but it is not particularly limited and may be appropriately selected depending on the intended purpose, as long as it is capable of receiving transferred, unfixed image after developed; and PET bases for OHP may also be used.

<Fixing Unit>

The fixing unit is a unit configured to fix the transferred image onto the recording medium using a fixing member, and may fix every time each color toner is transferred onto the recording medium or at a time superimposed individual color toners onto the recording medium.

The fixing member is not particularly limited and may be appropriately selected depending on the intended purpose. A heat-pressure member known in the art is preferably used. Examples of the heat-pressure members include a combination of a heat roller and a pressure roller, and a combination of a heat roller, a pressure roller and an endless belt.

The heating temperature in the heat-pressure member is preferably 80° C. to 200° C.

In the present invention, for example, an optical fixing device known in the art may be used in combination with the fixing unit or instead of the fixing unit.

<Other Units>

Other units are not particularly limited and may be appropriately selected depending on the intended purpose. Examples thereof include a charge eliminating unit, a cleaning unit, a recycling unit, and a controlling unit.

—Charge Eliminating Unit—

The charge eliminating unit is not particularly limited and may be appropriately selected depending on the intended purpose, as long as it can apply a charge-eliminating bias to the latent electrostatic image bearing member. Examples thereof include a charge eliminating lamp.

—Cleaning Unit—

The cleaning unit is not particularly limited and may be appropriately selected depending on the intended purpose, as long as it can remove the toner remaining and adhering onto the surface of the latent electrostatic image bearing member. Examples thereof include a magnetic brush cleaner, an electrostatic brush cleaner, a magnetic roller cleaner, a blade cleaner, a brush cleaner, and a web cleaner.

—Recycling Unit—

The recycling unit is not particularly limited and may be appropriately selected depending on the intended purpose. Examples thereof include known conveying units.

—Controlling Unit—

The controlling unit is not particularly limited and may be appropriately selected depending on the intended purpose, as long as it is capable of controlling the operations of each of the units. Examples thereof include equipments such as sequencers and computers.

Subsequently, one embodiment in which the image forming method is carried out using the color image forming apparatus of the present invention will be described with reference to FIG. 3. An image forming apparatus 100 shown in FIG. 3 includes a photoconductor drum 10 (hereinafter, referred to as photoconductor 10) serving as the latent electrostatic image bearing member, a charging roller 20 serving as the charging unit, exposure 30 by means of an exposing device serving as the exposing unit, a developing device 40, an intermediate transfer medium 50, a cleaning device 60 serving as the cleaning unit having a cleaning blade, and a charge eliminating lamp 70 serving as the charge eliminating unit.

The intermediate transfer medium 50 is an endless belt, which is stretched around three rollers 51 so as to be movable in the arrow direction. A part of the three rollers 51 also functions as a transfer bias roller that is capable of applying a predetermined transfer bias (primary transfer bias) to the intermediate transfer medium 50. For the intermediate transfer medium 50, arranged in the vicinity thereof is a cleaning unit 90 having a cleaning blade, and arranged opposing thereto is a transfer roller 80 serving as the transferring unit capable of applying a transfer bias to transfer (secondarily transfer) a visible image (toner image) onto transfer paper 95 as the final recording medium. Around the intermediate transfer medium 50, arranged is a corona charger 58 for applying a charge to the visible image on the intermediate transfer medium 50, in the rotating direction of the intermediate transfer medium 50, between a contact portion between the photoconductor 10 and the intermediate transfer medium 50 and a contact portion between the intermediate transfer medium 50 and the transfer paper 95.

The developing device 40 consists of a developing belt 41 serving as the developer bearing member and a black developing unit 45K, a yellow developing unit 45Y, a magenta developing unit 45M, and a cyan developing unit 45C provided side by side around the developing belt 41. The black developing unit 45K includes a developer containing portion 42K, a developer feed roller 43K, and a developing roller 44K. The yellow developing unit 45Y includes a developer containing portion 42Y, a developer feed roller 43Y, and a developing roller 44Y. The magenta developing unit 45M includes a developer containing portion 42M, a developer feed roller 43M, and a developing roller 44M. The cyan developing unit 45C includes a developer containing portion 42C, a developer feed roller 43C, and a developing roller 44C. In addition, the developing belt 41 is an endless belt, which is rotatably stretched around a plurality of belt rollers and a part of which contacts with the photoconductor 10.

Figure 3:
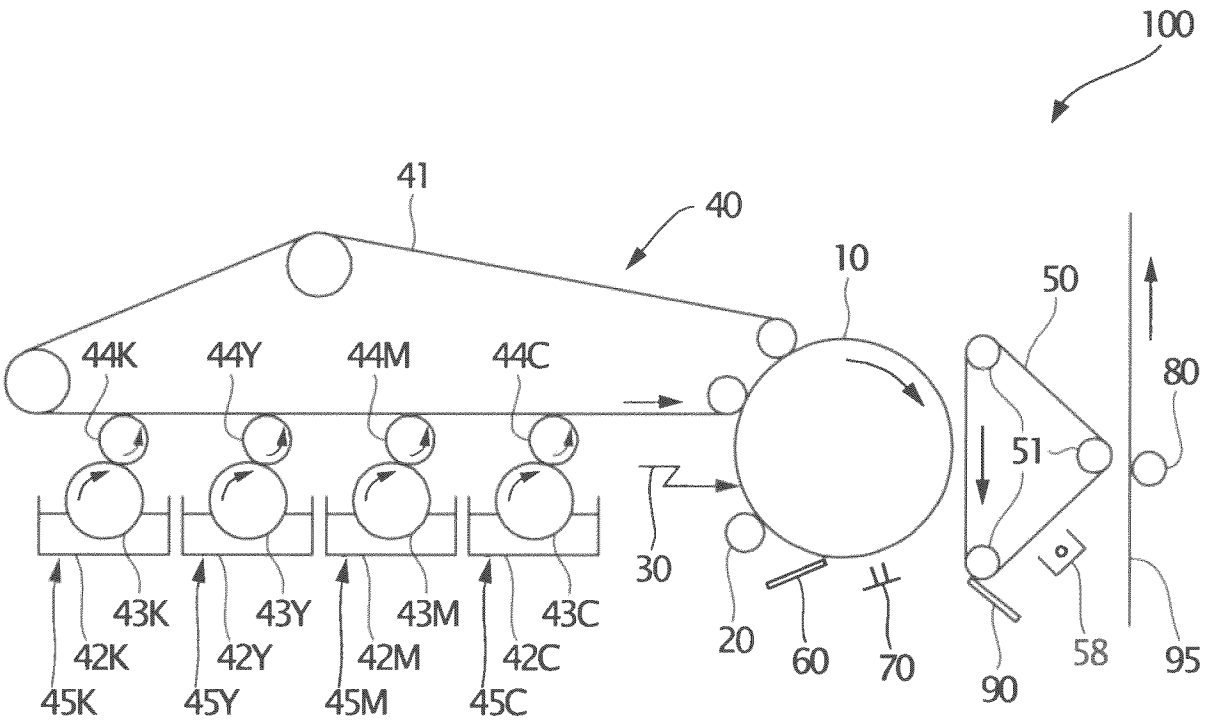
FIG. 3 shows a schematic configuration of an example of a color image forming apparatus of the present invention.

In the color image forming apparatus 100 shown in FIG. 3, for example, the charging roller 20 uniformly charges the photoconductor drum 10. The exposing device carries out exposure 30 imagewise on the photoconductor drum 10 to form a latent electrostatic image. The latent electrostatic image formed on the photoconductor drum 10 is developed by feeding a toner from the developing device 40 to form a visible image (toner image). The visible image (toner image) is transferred (primary transfer) onto the intermediate transfer medium 50 by a voltage applied from the rollers 51 and is further transferred (secondary transfer) onto the recording medium 95. As a result, a transfer image is formed on the recording medium 95. Here, a residual toner on the photoconductor 10 is removed by the cleaning device 60, and charging on the photoconductor 10 is once removed by the charge eliminating lamp 70.

Figure 4:
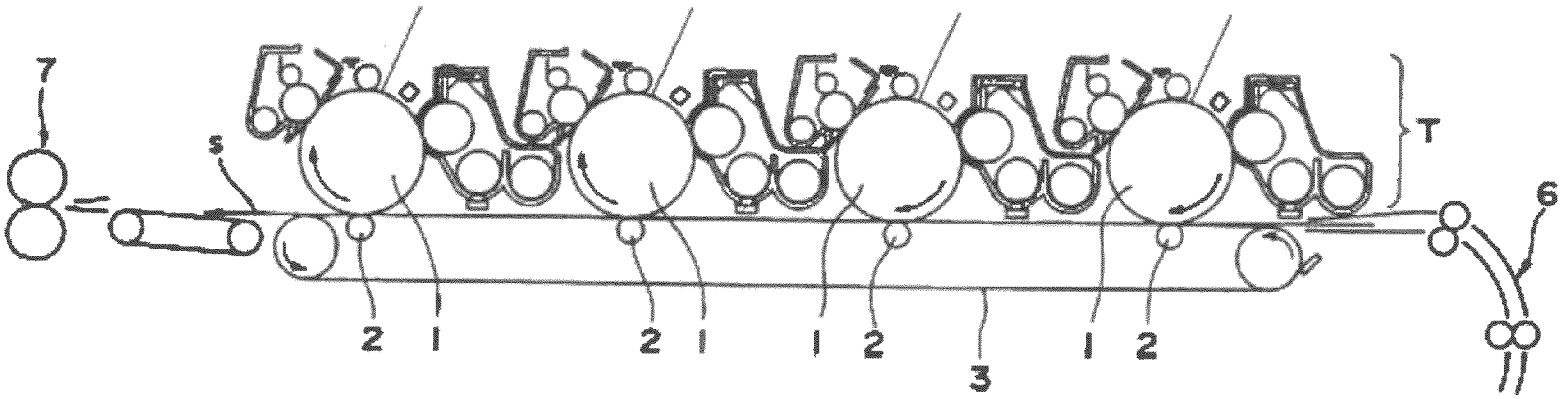
FIG. 4 shows a schematic configuration of an example of another color image forming apparatus of the present invention.
Figure 5:
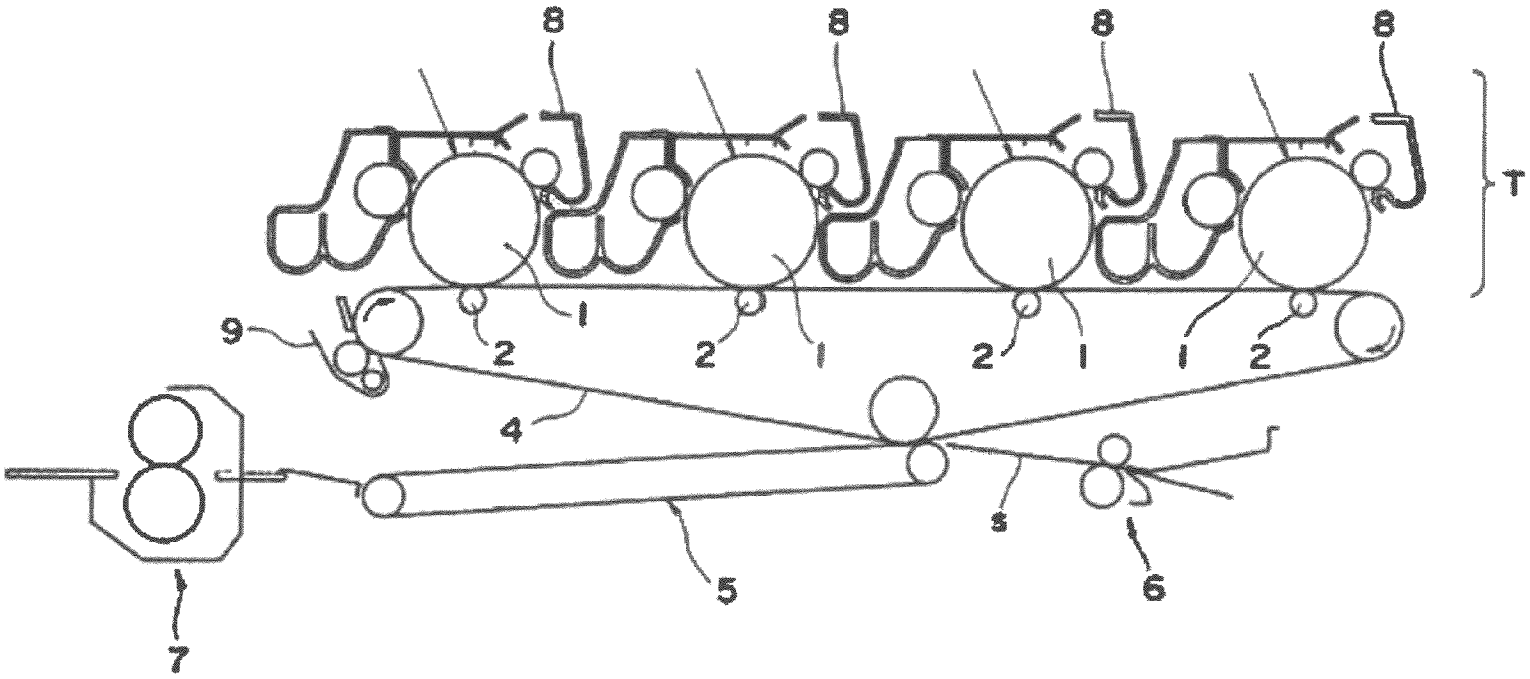
FIG. 5 shows a schematic configuration of an example of still another color image forming apparatus of the present invention.

A tandem electrophotographic apparatus which performs using the color image forming apparatus of the present invention an image forming method includes the following: a direct transfer system and an indirect transfer system: in the direct transfer system, images formed on each of photoconductors 1 are transferred sequentially by a transferring unit 2 onto a sheet S which is transported by a sheet conveying belt 3, as shown in FIG. 4; and in the indirect transfer system, images on each photoconductor 1 are temporarily transferred sequentially by a primary transferring unit 2 to the surface of an intermediate transfer medium 4 and then all the images on the intermediate transfer medium 4 are transferred together onto the sheet S at a time by a secondary transferring unit 5 as shown in FIG. 5. As the secondary transferring unit 5, a transfer-conveying belt is used, and it may be in a roller shape.

The direct transfer system, as compared to the indirect transfer system, has a drawback of glowing in size in a transporting direction of a sheet because a paper feeding unit 6 must be placed on the upper stream of a tandem image forming section T where the photoconductors 1 are aligned, whereas a fixing unit 7 must be placed on the lower stream of the section. In contrast, in the indirect transfer system the secondary transfer position may be arranged relatively freely, and the paper feeding unit 6 and the fixing unit 7 may be arranged overlapping the tandem image forming section T. As a result, the indirect transfer system allows the apparatus to be downsized.

To avoid size-glowing in the transporting direction of the sheet in the direct transfer system, the fixing unit 7 is arranged adjacent to the tandem image forming section T. However, it is impossible to arrange the fixing unit 7 in a way that gives enough space for the sheet S to bend, and the fixing unit 7 may easily affect the image formation on the upper side by the impact generated from the leading end of the sheet S as it approaches the fixing unit 7 (this becomes conspicuous with a thick sheet), or by the difference between the transporting speed of the sheet when it passes through the fixing unit 7 and the transporting speed of the sheet when it is transported by the transfer-conveying belt. In contrast, since the indirect transfer system allows the fixing unit 7 to be arranged in a way that gives the sheet S an enough space to bend, the fixing unit 7 has almost no effect on the image formation.

For the above reasons, the indirect transfer system of the tandem electrophotographic apparatus is particularly interested recently.

This type of color electrophotographic apparatus, as shown in FIG. 5, prepares for the next image formation by removing a residual toner remaining on the photoconductors 1 after the primary transfer by photoconductor cleaning units 8 to clean the surface of the photoconductors 1. It also prepares for the next image formation by removing a residual toner remaining on the intermediate transfer medium 4 after the secondary transfer by an intermediate transfer medium cleaning unit 9 to clean the surface of the intermediate transfer medium 4.

Figure 6:
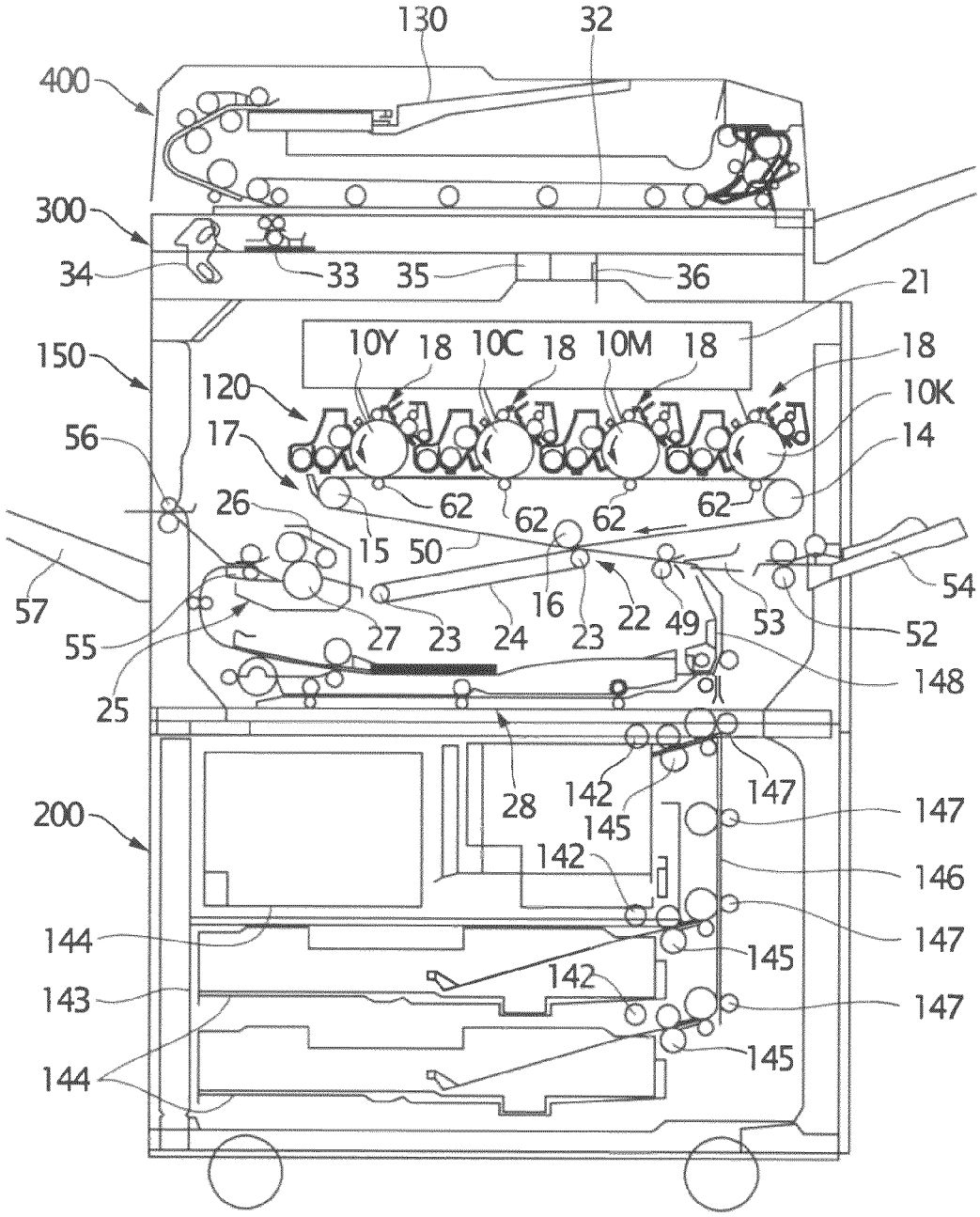
FIG. 6 shows a schematic configuration of an example of further still another color image forming apparatus of the present invention.

A color image forming apparatus shown in FIG. 6 includes a main body 150 of the copying apparatus, a paper supply table 200, a scanner 300 and an automatic document feeder (ADF) 400.

In the main body 150, an endless belt intermediate transfer medium 50 is provided at the center portion. The intermediate transfer medium 50 is stretched around support rollers 14, 15, and 16 and is made rotatable clockwise in FIG. 6. In the vicinity of the support roller 15, arranged is a cleaning device 17 for removing a residual toner on the intermediate transfer medium 50. On the intermediate transfer medium 50 stretched by the support roller 14 and the support roller 15, arranged along its conveying direction is a tandem developing device 120 for which four yellow, cyan, magenta, and black image forming units 18 facing juxtaposed to each other. In the vicinity of the tandem developing device 120, arranged is an exposing device 21. On the side of the intermediate transfer medium 50, which side is opposite to the side where the tandem developing device 120 is arranged, a secondary transferring device 22 is arranged. In the secondary transferring device 22, a secondary transfer belt 24 serving as an endless belt is stretched across a pair of rollers 23, and a recording medium conveyed on the secondary transfer belt 24 and the intermediate transfer medium 50 can come into contact each other. In the vicinity of the secondary transferring device 22, arranged is a fixing device 25. The fixing device 25 includes a fixing belt 26 serving as an endless belt and a pressure roller 27 arranged while being pressed thereagainst.

Here, in the tandem image forming apparatus, arranged in the vicinity of the secondary transferring device 22 and the fixing device 25 is a sheet reversing device 28 for reversing a recording medium in order to form images on both surfaces of the recording medium.

Next, formation of a full-color image (color copy) using the tandem developing device 120, namely, a developing system using a plurality of the developing units for at least four developing colors, which are arranged in tandem, will be described. That is, first, a document is set on a document table 130 of the automatic document feeder (ADF) 400, or the automatic document feeder 400 is opened and a document is set on a contact glass 32 of the scanner 300, and then the automatic document feeder 400 is closed.

When the document has been set on the automatic document feeder 400, the scanner 300 is driven after the document is conveyed and moved onto the contact glass 32; on the other hand, when the document has been set on the contact glass 32, the scanner 300 is immediately driven, upon pressing a start switch (not shown), and a first traveler 33 and a second traveler 34 travel. At this time, by the first traveler 33, light from a light source is irradiated while a reflected light from the document surface is reflected by a mirror of the second traveler 34, the light is received by a reading sensor 36 through an imaging lens 35, and thus the color document (color image) is read as black, yellow, magenta, and cyan image information.

Figure 7:
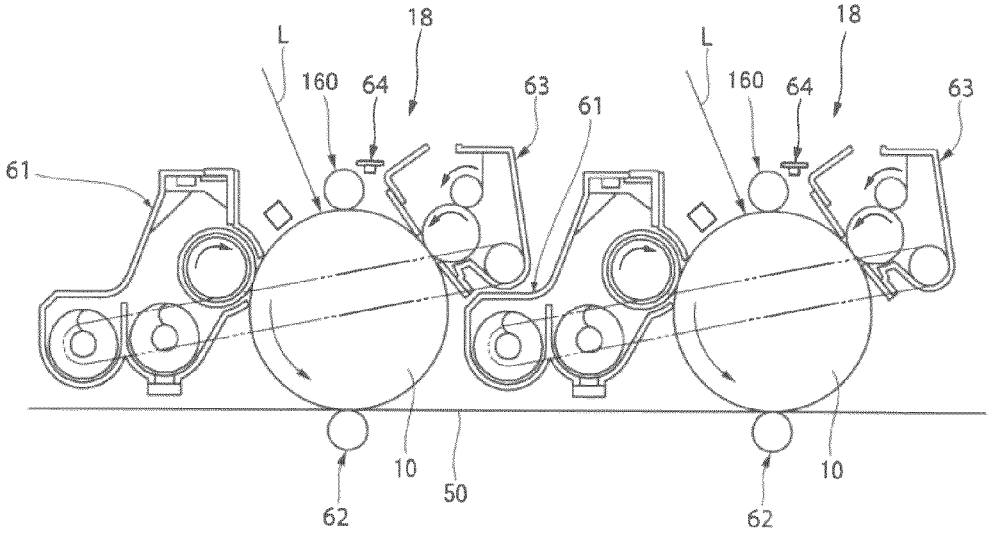
FIG. 7 is a partial enlarged view of FIG. 6.

Then, the respective black, yellow, magenta, and cyan image information are transmitted to the respective image forming units 18 (black image forming unit, yellow image forming unit, magenta image forming unit, and cyan image forming unit) of the tandem developing device 120, respectively, and black, yellow, magenta, and cyan toner images are formed by the respective image forming units. That is, the respective image forming units 18 (black image forming unit, yellow image forming unit, magenta image forming unit, and cyan image forming unit) of the tandem developing device 120 include, as shown in FIG. 7, photoconductors 10 (black photoconductor 10K, yellow photoconductor 10Y, magenta photoconductor 10M, and cyan photoconductor 10C), chargers 160 that uniformly charge the photoconductors 10, exposures that expose ("L" in FIG. 7) the photoconductors imagewise corresponding to respective color images based on the respective color image information and thereby form latent electrostatic images corresponding to the respective color images on the photoconductors, developing units 61 that develop the latent electrostatic images with respective color toners (black toner, yellow toner, magenta toner, and cyan toner) to form toner images of the respective color toners, transfer chargers 62 that transfer the toner images onto the intermediate transfer medium 50, cleaning devices 63, and charge eliminating devices 64, respectively, and are capable of forming the respective single-color images (black image, yellow image, magenta image, and cyan image) based on the respective color image information. For the thus formed black image, yellow image, magenta image, and cyan image, a black image formed on the black photoconductor 10K, a yellow image formed on the yellow photoconductor 10Y, a magenta image formed on the magenta photoconductor 10M, and a cyan image formed on the cyan photoconductor 10C are respectively transferred (primary transfer) in sequence onto the intermediate transfer medium 50 rotationally moved by the support rollers 14, 15, and 16. Then, the black image, the yellow image, the magenta image, and the cyan image are superimposed on the intermediate transfer medium 50 to form a composite color image (color transfer image).

On the other hand, in the paper feed table 200, one of the paper feed rollers 142 is selectively rotated to let sheets (recording medium) out from one of the paper feed cassettes 144 provided in multiple tiers in a paper bank 143, and the sheets are separated from one another by a separation roller 145 and sent out one by one to a paper feed path 146, are conveyed by a conveyance roller 147 and guided to a paper feed path 148 within the main body 150 of the copying apparatus, and are made to hit against a registration roller 49 and stopped. Alternatively, the paper feed roller 142 is rotated to let sheets (recording medium) on a manual feed tray 54, and the sheets are separated from one another by the separation roller 52 and fed one by one into a manual paper feed path 53, and are similarly made to hit against the registration roller 49 and stopped. Here, the registration roller 49 is generally used grounded, but it may be used in a state where a bias is applied for removing paper powder of the sheets. Then, the registration roller 49 is rotated synchronously with the movement of the composite color image (color transfer image) on the intermediate transfer medium 50 to send out the sheet (recording medium) between the intermediate transfer medium 50 and the secondary transferring unit 22, and the composite color image (color transfer image) is transferred (secondary transfer) onto the sheet (recording medium) by means of the secondary transferring unit 22 so as to form a color image on the sheet (recording medium). The residual toner on the intermediate transfer medium 50 after image is transferred is cleaned by the cleaning device 17 for the intermediate transfer medium.

The sheet (recording medium) on which a color image is transferred and formed is conveyed by the secondary transferring device 22 and sent out to the fixing device 25, and in the fixing device 25, the composite color image (color transfer image) is fixed onto the sheet (recording medium) by heat and pressure. Then, the sheet (recording medium) is switched by a switching claw 55, is ejected by an ejecting roller 56, and is stacked on an output tray 57, or the sheet (recording medium) is switched by the switching claw 55, is reversed by the sheet reversing device 28, is guided again to the transfer position for recording an image on a back surface thereof, and then is ejected by the ejecting roller 56 and is stacked on the output tray 57.

EXAMPLES

The present invention will be described in more detail with reference to the following Examples and Comparative Examples. However, it should be noted that the present invention is not limited to these Examples.

Example 1

Production of Toner 1

—Synthesis of Resin Fine Particle Emulsion 1 (Fine Particle Dispersion Liquid 1)—

Into a reaction vessel equipped with a stirring rod and a thermometer, 683 parts by mass of water, 11 parts by mass of sodium salt of methacrylic acid ethylene oxide adduct sulfate ester (ELEMINOL RS-30, manufactured by Sanyo Chemical Industries, Ltd.), 10 parts by mass of polylactic acid, 60 parts by mass of styrene, 100 parts by mass of methacrylic acid, 70 parts by mass of butyl acrylate, and 1 part by mass of ammonium persulfate were charged and then stirred at 3,800 rpm for 30 minutes, to thereby obtain a white emulsion. Then, the temperature of the reaction system was raised to 75° C. by heating and reacted for 4 hours. Further, 30 parts by mass of a 1% by mass aqueous ammonium persulfate solution was added to the reaction system and aged at 75° C. for 6 hours to thereby obtain an aqueous dispersion liquid of a vinyl resin (a copolymer of styrene-methacrylate-butyl acrylate-sodium salt of methacrylic acid ethylene oxide adduct sulfate ester), i.e., Fine Particle Dispersion Liquid 1.

The volume average particle diameter of Fine Particle Dispersion Liquid 1 was 280 nm as measured with a particle size distribution measurement device (LA-920, manufactured by HORIBA, Ltd.). A part of Fine Particle Dispersion Liquid 1 was dried so that the resin part was isolated therefrom. The resin part had Tg of 59° C., and a weight average molecular weight of 60,000.

—Preparation of Aqueous Phase—

Water (990 parts by mass), 83 parts by mass of Fine Particle Dispersion Liquid 1 and 37 parts by mass of a 48.3% by mass aqueous solution of sodium dodecyldiphenyl ether disulfonate (ELEMINOL MON-7, manufactured by Sanyo Chemical Industries, Ltd.) and 90 parts by mass of ethyl acetate were mixed and stirred, to thereby obtain an opaque white liquid. This was defined as Aqueous Phase 1.

—Synthesis of Low Molecular Weight Polyester Resin 1 (Unmodified Polyester Resin)—

Into a reaction vessel equipped with a cooling tube, a stirrer, and a nitrogen-introducing tube, 229 parts by mass of bisphenol A ethylene oxide (2 mol) adduct, 329 parts by mass of bisphenol A propylene oxide (3 mol) adduct, 208 parts by mass of terephthalic acid, 80 parts by mass of adipic acid and 2 parts by mass of dibutyltin oxide were charged, and the mixture was allowed to react under normal pressure at 230° C. for 7 hours, and to further react under reduced pressure of 10 mmHg to 15 mmHg for 5 hours. Subsequently, into the reaction vessel, 35 parts by mass of trimellitic anhydride was charged, and the mixture was allowed to react at 180° C. under normal pressure for 2 hours, to thereby synthesize Low Molecular Weight Polyester Resin 1.

The Low Molecular Weight Polyester Resin 1 had a number average molecular weight of 2,000, a weight average molecular weight of 3,800, a glass transition temperature Tg of 40° C., and an acid value of 25 mgKOH/g.

—Synthesis of Intermediate Polyester—

Into a reaction vessel equipped with a cooling tube, a stirrer and a nitrogen inlet tube, 682 parts by mass of bisphenol A ethylene oxide (2 mol) adduct, 81 parts by mass of bisphenol A propylene oxide (2 mol) adduct, 283 parts by mass of terephthalic acid, 22 parts by mass of trimellitic anhydride and 2 parts by mass of dibutyltin oxide were charged, and the mixture was allowed to react under normal pressure at 230° C. for 7 hours, and to further react under reduced pressure of 10 mmHg to 15 mmHg for 5 hours, to thereby obtain Intermediate Polyester 1.

Intermediate Polyester 1 had a number average molecular weight of 2,200, a weight average molecular weight of 9,700, a glass transition temperature Tg of 54° C., an acid value of 0.5 mgKOH/g, and a hydroxyl value of 52 mgKOH/g.

Next, into a reaction vessel equipped with a cooling tube, a stirrer and a nitrogen inlet tube, 410 parts by mass of Intermediate Polyester 1, 89 parts by mass of isophoronediisocyanate and 500 parts by mass of ethyl acetate were charged, and the mixture was allowed to react at 100° C. for 5 hours to prepare Prepolymer 1, i.e., modified polyester resin. The content of free isocyanate was 1.53% by mass in Prepolymer 1.

—Synthesis of Ketimine—

Into a reaction vessel equipped with a stirring rod and a thermometer, 170 parts by mass of isophorone diamine and 75 parts by mass of methyl ethyl ketone were charged, and the mixture was allowed to react at 50° C. for four and half an hour to obtain Ketimine Compound 1. Ketimine Compound 1 had an amine value of 417.

—Synthesis of Masterbatch (MB)—

Water (1,200 parts by mass), 540 parts by mass of carbon black (Printex 35 manufactured by Degussa, DBP oil absorption amount: 42 mL/100 mg, pH 9.5), and 1,200 parts by mass of a polyester resin were mixed using HENSCHEL MIXER (manufactured by NIPPON COKE & ENGINEERING CO., LTD.), to obtain a mixture. The resultant mixture was kneaded at 110° C. for 1 hour with a two-roller mill, and thereafter rolled and cooled, and pulverized with a pulverizer, to thereby prepare Masterbatch 1.

—Synthesis of Crystalline Polyester Resin—

Into a reaction vessel equipped with a cooling tube, a stirrer and a nitrogen inlet tube, 1,200 parts by mass of 1,6-hexanediol, 1,200 parts by mass of decanedioic acid, 0.4 parts by mass of dibutyltin oxide as a catalyst were charged, and the vessel was purged with nitrogen gas to form an inactive atmosphere under reduced pressure, followed by stirring the mixture at 180 rpm using a mechanical stirrer for 5 hours. Thereafter, the temperature of the vessel was gradually increased to 220° C. under reduced pressure, followed by stirring the mixture for 2 hours. When the mixture became a viscous state, it was cooled by air, and the reaction was terminated, to thereby obtain Crystalline Polyester Resin 1. Crystalline Polyester Resin 1 had a number average molecular weight of 3,700, a weight average molecular weight of 16,000, and a melting point of 69° C.

—Production of Oil Phase—

Into a reaction vessel equipped with a stirring rod and a thermometer, 378 parts by mass of Low molecular Weight Polyester Resin 1, 120 parts by mass of paraffin wax (melting point: 90° C.), 200 parts by mass of Crystalline Polyester Resin 1, and 947 parts by mass of ethyl acetate were charged, and the mixture was heated to 80° C. while stirring and maintained at 80° C. for 5 hours, and then cooled to 30° C. for 1 hour. Then, 500 parts by mass of Masterbatch 1 and 500 parts by mass of ethyl acetate were charged into the vessel, and the mixture was mixed for 1 hour, to thereby obtain Raw Material Liquid 1.

Raw Material Liquid 1 (1,324 parts by mass) was transferred to a vessel, and carbon black and wax were dispersed with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. Subsequently, 1,324 parts by mass of a 65% by mass of ethyl acetate solution of Low molecular Weight Polyester Resin 1 were added to Raw Material Liquid 1 and passed through the bead mill twice under the conditions described above, to thereby obtain Pigment/Wax Dispersion Liquid 1. The solid content concentration of the Pigment/Wax Dispersion 1 was 50% at 130° C. for 30 minutes.

—Emulsification and Desolvent—

Pigment/Wax Dispersion Liquid 1 (749 parts by mass), 115 parts by mass of Prepolymer 1, 2.9 parts by mass of Ketimine Compound 1 were charged into a vessel, mixed at 5,000 rpm for 5 minutes using a TK homomixer (manufactured by Tokushu Kikai Kogyo Co. Ltd.), and then 1, 200 parts by mass of Aqueous Phase 1 were added to the vessel and mixed at 10,000 rpm for 1 hour using the TK homomixer, to thereby obtain Emulsion Slurry 1.

In a vessel equipped with a stirrer and a thermometer, Emulsion Slurry 1 was charged, and the solvent was removed at 30° C. for 8 hours, and then aged at 40° C. for 48 hours, to thereby obtain Dispersion Slurry 1.

—Washing and Drying—

After 100 parts by mass of Dispersion Slurry 1 was filtered under reduced pressure, washing and drying were performed as follows.

(1): 100 parts by mass of ion exchanged water were added to the resultant filter cake and mixed using a TK homomixer at 12,000 rpm for 10 minutes, and then filtered.

(2): Into the filter cake prepared in (1), 100 parts by mass of a 10% by mass aqueous sodium hydroxide solution were added, mixed at 12,000 rpm for 30 minutes using the TK homomixer and filtered under reduced pressure.

(3): Into the filter cake prepared in (2), 100 parts by mass of a 10% by mass hydrochloric acid were added, mixed at 12,000 rpm for 10 minutes using the TK homomixer and then filtered.

(4): Into the filter cake prepared in (3), 300 parts by mass of ion exchanged water were added, mixed at 12,000 rpm for 10 minutes using the TK homomixer and then filtered. This treatment was performed twice, to thereby obtain Filter Cake 1.

Filter Cake 1 was dried at 45° C. for 48 hours using an air circulating dryer, followed by being screened through a mesh of 75 μm-opening, to thereby prepare Toner Base Particles 1.

Thereafter, 100 parts by mass of Toner Base Particles 1 and 1 part by mass of hydrophobized silica having a particle diameter of 13 nm were mixed using a HENSCHEL MIXER, to thereby prepare Toner 1.

Example 2

Production of Toner 2

Toner 2 was produced in the same manner as in Example 1, except that Resin Fine Particle Emulsion 1 was replaced with the following Resin Fine Particle Emulsion 2 (Fine Particle Dispersion Liquid 2).

—Synthesis of Resin Fine Particle Emulsion 2 (Fine Particle Dispersion Liquid 2)—

Into a reaction vessel equipped with a stirring rod and a thermometer, 683 parts by mass of water, 11 parts by mass of sodium salt of methacrylic acid ethylene oxide adduct sulfate ester (ELEMINOL RS-30, manufactured by Sanyo Chemical Industries, Ltd.), 10 parts by mass of polylactic acid, 60 parts by mass of styrene, 100 parts by mass of methacrylic acid, 70 parts by mass of butyl acrylate, and 1 part by mass of ammonium persulfate were charged and then stirred at 3,800 rpm for 20 minutes, to thereby obtain a white emulsion. Then, the temperature of the reaction system was raised to 75° C. by heating and reacted for 3 hours. Further, 30 parts by mass of a 1% by mass aqueous ammonium persulfate solution was added to the reaction system and aged at 65° C. for 12 hours to thereby obtain an aqueous dispersion liquid of a vinyl resin (a copolymer of styrene-methacrylate-butyl acrylate-sodium salt of methacrylic acid ethylene oxide adduct sulfate ester), i.e., Fine Particle Dispersion Liquid 2. The volume average particle diameter of Fine Particle Dispersion Liquid 2 was 390 nm as measured with a particle size distribution measurement device (LA-920, manufactured by HORIBA, Ltd.). A part of Fine Particle Dispersion Liquid 2 was dried so that the resin part was isolated therefrom. The resin part had Tg of 60° C., and a weight average molecular weight of 70,000.

Example 3

Production of Toner 3

Toner 3 was produced in the same manner as in Example 1, except that Resin Fine Particle Emulsion 1 and Low Molecular Weight Polyester Resin 1 were replaced with the following Resin Fine Particle Emulsion 3 (Fine Particle Dispersion Liquid 3) and Low Molecular Weight Polyester Resin 2.

—Synthesis of Resin Fine Particle Emulsion 3 (Fine Particle Dispersion Liquid 3—

Into a reaction vessel equipped with a stirring rod and a thermometer, 683 parts by mass of water, 11 parts by mass of sodium salt of methacrylic acid ethylene oxide adduct sulfate ester (ELEMINOL RS-30, manufactured by Sanyo Chemical Industries, Ltd.), 10 parts by mass of polylactic acid, 60 parts by mass of styrene, 100 parts by mass of methacrylic acid, 70 parts by mass of butyl acrylate, and 1 part by mass of ammonium persulfate were charged and then stirred at 2,000 rpm for 20 minutes, to thereby obtain a white emulsion. Then, the temperature of the reaction system was raised to 75° C. by heating and reacted for 3 hours. Further, 30 parts by mass of a 1% by mass aqueous ammonium persulfate solution was added to the reaction system and aged at 65° C. for 12 hours to thereby obtain an aqueous dispersion liquid of a vinyl resin (a copolymer of styrene-methacrylate-butyl acrylate-sodium salt of methacrylic acid ethylene oxide adduct sulfate ester), i.e., Fine Particle Dispersion Liquid 3. The volume average particle diameter of Fine Particle Dispersion Liquid 3 was 640 nm as measured with a particle size distribution measurement device (LA-920, manufactured by HORIBA, Ltd.). A part of Fine Particle Dispersion Liquid 3 was dried so that the resin part was isolated therefrom. The resin part had Tg of 59° C., and a weight average molecular weight of 120,000.

—Synthesis of Low Molecular Weight Polyester Resin 2—

Into a reaction vessel equipped with a cooling tube, a stirrer, and a nitrogen-introducing tube, 430 parts by mass of bisphenol A propylene oxide (2 mol) adduct, 300 parts by mass of bisphenol A propylene oxide (3 mol) adduct, 257 parts by mass of terephthalic acid, 65 parts by mass of isophthalic acid, 10 parts by mass of maleic anhydride and 2 parts by mass of titaniumdihydroxybis(triethanolaminate) as a condensation catalyst were charged, and the mixture was allowed to react at 220° C. for 8 hours under a nitrogen stream while water generated was distilled away, and to further react under reduced pressure of 5 mmHg to 20 mmHg. Next, when the resultant product had an acid value of 7 mgKOH/g, it was taken out from the reaction vessel and was cooled to room temperature, and pulverized, to thereby obtain Low Molecular Weight Polyester Resin 2. The Low Molecular Weight Polyester Resin 2 had a number average molecular weight of 6,020, a weight average molecular weight of 25,600, a glass transition temperature Tg of 59° C., and an acid value of 8 mgKOH/g.

Example 4

Production of Toner 4

Toner 4 was produced in the same manner as in Example 1, except that Aqueous Phase 1 and Low Molecular Weight Polyester Resin 1 were replaced with Aqueous Phase 2 and Low Molecular Weight Polyester Resin 2.

—Preparation of Aqueous Phase 2—

Water (1,013 parts by mass), 60 parts by mass of Fine Particle Dispersion Liquid 1 and 37 parts by mass of a 48.3% by mass aqueous solution of sodium dodecyldiphenyl ether disulfonate (ELEMINOL MON-7, manufactured by Sanyo Chemical Industries, Ltd.) and 90 parts by mass of ethyl acetate were mixed and stirred, to thereby obtain an opaque white liquid. This was defined as Aqueous Phase 2.

Example 5

Production of Toner 5

Toner 5 was produced in the same manner as in Example 1, except that Aqueous Phase 1 was replaced with Aqueous Phase 3.

—Preparation of Aqueous Phase 3—

Water (1,013 parts by mass), 60 parts by mass of Fine Particle Dispersion Liquid 2 and 37 parts by mass of a 48.3% by mass aqueous solution of sodium dodecyldiphenyl ether disulfonate (ELEMINOL MON-7, manufactured by Sanyo Chemical Industries, Ltd.) and 90 parts by mass of ethyl acetate were mixed and stirred, to thereby obtain an opaque white liquid. This was defined as Aqueous Phase 3.

Example 6

Production of Toner 6

Toner 6 was produced in the same manner as in Example 1, except that Low Molecular Weight Polyester Resin 1 was replaced with Low Molecular Weight Polyester Resin 2.

Example 7

Production of Toner 7

Toner 7 was produced in the same manner as in Example 1, except that Low Molecular Weight Polyester Resin 1 was replaced with Low Molecular Weight Polyester Resin 3.

—Synthesis of (Amorphous) Low Molecular Weight Polyester Resin 3—

Into a reaction vessel equipped with a cooling tube, a stirrer, and a nitrogen-introducing tube, 219 parts by mass of bisphenol A ethylene oxide (2 mol) adduct, 319 parts by mass of bisphenol A propylene oxide (3 mol) adduct, 208 parts by mass of terephthalic acid, 100 parts by mass of adipic acid and 2 parts by mass of dibutyltin oxide were charged, and the mixture was allowed to react under normal pressure at 230° C. for 7 hours, and to further react under reduced pressure of 10 mmHg to 15 mmHg for 5 hours. Subsequently, into the reaction vessel, 35 parts of trimellitic anhydride was charged, and the mixture was allowed to react at 180° C. under normal pressure for 2 hours, to thereby synthesize Low Molecular Weight Polyester Resin 3. The Low Molecular Weight Polyester Resin 3 had a number average molecular weight of 1,900, a weight average molecular weight of 3,400, a glass transition temperature Tg of 40° C., and an acid value of 23 mgKOH/g.

Example 8

Production of Toner 8

Toner 8 was produced in the same manner as in Example 1, except that Aqueous Phase 1 and Low Molecular Weight Polyester Resin 1 were replaced with Aqueous Phase 4 and Low Molecular Weight Polyester Resin 2.

—Preparation of Aqueous Phase 4—

Water (1,013 parts by mass), 60 parts by mass of Fine Particle Dispersion Liquid 3 and 37 parts by mass of a 48.3% by mass aqueous solution of sodium dodecyldiphenyl ether disulfonate (ELEMINOL MON-7, manufactured by Sanyo Chemical Industries, Ltd.) and 90 parts by mass of ethyl acetate were mixed and stirred, to thereby obtain an opaque white liquid. This was defined as Aqueous Phase 4.

Example 9

Production of Toner 9

Toner 9 was produced in the same manner as in Example 1, except that Aqueous Phase 1 was replaced with Aqueous Phase 5.

—Preparation of Aqueous Phase 5—

Water (980 parts by mass), 93 parts by mass of Fine Particle Dispersion Liquid 1 and 37 parts by mass of a 48.3% by mass aqueous solution of sodium dodecyldiphenyl ether disulfonate (ELEMINOL MON-7, manufactured by Sanyo Chemical Industries, Ltd.) and 90 parts by mass of ethyl acetate were mixed and stirred, to thereby obtain an opaque white liquid. This was defined as Aqueous Phase 5.

Example 10

Production of Toner 10

Toner 10 was produced in the same manner as in Example 1, except that Aqueous Phase 1 was replaced with Aqueous Phase 6.

—Preparation of Aqueous Phase 6—

Water (1,023 parts by mass), 50 parts by mass of Fine Particle Dispersion Liquid 2 and 37 parts by mass of a 48.3% by mass aqueous solution of sodium dodecyldiphenyl ether disulfonate (ELEMINOL MON-7, manufactured by Sanyo Chemical Industries, Ltd.) and 90 parts by mass of ethyl acetate were mixed and stirred, to thereby obtain an opaque white liquid. This was defined as Aqueous Phase 6.

Example 11

Production of Toner 11

Toner 11 was produced in the same manner as in Example 1, except that Aqueous Phase 1 was replaced with Aqueous Phase 7.

—Synthesis of Resin Fine Particle Emulsion 4 (Fine Particle Dispersion Liquid 4—

Into a reaction vessel equipped with a stirring rod and a thermometer, 96 parts by mass of dimethyl terephtalate, 86 parts by mass of dimethyl isophthalate, 3 parts by mass of sodium 5-sulfoisophthalate methyl ester, 5 parts by mass of trimellitic anhydride, 150 parts by mass of propylene glycol, 0.1 parts by mass of tetrabutoxytitanate were charged, and heated at 200° C. for 120 minutes, so as to perform transesterification. Then, the temperature of the reaction system was raised to 220° C., and the mixture was allowed to react for 60 minutes under pressure of 1 mmHg to 10 mmHg, to thereby obtain a polyester resin.

The resultant polyester resin (40 parts by mass), 15 parts by mass of methyl ethyl ketone, and 10 parts by mass of tetrahydrofuran were dissolved at 80° C., and 60 parts by mass of water at 80° C. was added to the mixture while stirring. From the mixture, a solvent was removed under reduced pressure, and ion exchanged water was added to the mixture, to thereby obtain Fine Particle Dispersion Liquid 4 having a solid content of 20% by mass. The volume average particle diameter of Fine Particle Dispersion Liquid 4 was 250 nm as measured with a particle size distribution measurement device (LA-920, manufactured by HORIBA, Ltd.). A part of Fine Particle Dispersion Liquid 4 was dried so that the resin part was isolated therefrom. The resin part had Tg of 59° C., and a weight average molecular weight of 50,000.

—Preparation of Aqueous Phase 7—

Water (1,013 parts by mass), 60 parts by mass of Fine Particle Dispersion Liquid 4 and 37 parts by mass of a 48.3% by mass aqueous solution of sodium dodecyldiphenyl ether disulfonate (ELEMINOL MON-7, manufactured by Sanyo Chemical Industries, Ltd.) and 90 parts by mass of ethyl acetate were mixed and stirred, to thereby obtain an opaque white liquid. This was defined as Aqueous Phase 7.

Example 12

Production of Toner 12

Toner 12 was produced in the same manner as in Example 1, except that Aqueous Phase 1 was replaced with Aqueous Phase 8.

—Preparation of Aqueous Phase 8—

Water (990 parts by mass), 83 parts by mass of Fine Particle Dispersion Liquid 4 and 37 parts by mass of a 48.3% by mass aqueous solution of sodium dodecyldiphenyl ether disulfonate (ELEMINOL MON-7, manufactured by Sanyo Chemical Industries, Ltd.) and 90 parts by mass of ethyl acetate were mixed and stirred, to thereby obtain an opaque white liquid. This was defined as Aqueous Phase 8.

Example 13

Production of Toner 13

Toner 13 was produced in the same manner as in Example 1, except that Aqueous Phase 1 and Low Molecular Weight Polyester Resin 1 were replaced with Aqueous Phase 9 and Low Molecular Weight Polyester Resin 2.

—Preparation of Aqueous Phase 9—

Water (980 parts by mass), 93 parts by mass of Fine Particle Dispersion Liquid 4 and 37 parts by mass of a 48.3% by mass aqueous solution of sodium dodecyldiphenyl ether disulfonate (ELEMINOL MON-7, manufactured by Sanyo Chemical Industries, Ltd.) and 90 parts by mass of ethyl acetate were mixed and stirred, to thereby obtain an opaque white liquid. This was defined as Aqueous Phase 9.

Comparative Example 1

Production of Toner 14

Toner 14 was produced in the same manner as in Example 1, except that Resin Fine Particle Emulsion 1 was replaced with Resin Fine Particle Emulsion 5 (Fine Particle Dispersion Liquid 5).

—Synthesis of Resin Fine Particle Emulsion 5 (Fine Particle Dispersion Liquid 5—

Into a reaction vessel equipped with a stirring rod and a thermometer, 683 parts by mass of water, 11 parts by mass of sodium salt of methacrylic acid ethylene oxide adduct sulfate ester (ELEMINOL RS-30, manufactured by Sanyo Chemical Industries, Ltd.), 10 parts by mass of polylactic acid, 60 parts by mass of styrene, 100 parts by mass of methacrylic acid, 70 parts by mass of butyl acrylate, and 1 part by mass of ammonium persulfate were charged and then stirred at 3,800 rpm for 30 minutes, to thereby obtain a white emulsion. Then, the temperature of the reaction system was raised to 75° C. by heating and reacted for 4 hours. Further, 30 parts by mass of a 1% by mass aqueous ammonium persulfate solution was added to the reaction system and aged at 75° C. for 6 hours to thereby obtain an aqueous dispersion liquid of a vinyl resin (a copolymer of styrene-methacrylate-butyl acrylate-sodium salt of methacrylic acid ethylene oxide adduct sulfate ester), i.e., Fine Particle Dispersion Liquid 5. The volume average particle diameter of Fine Particle Dispersion Liquid 5 was 105 nm as measured with a particle size distribution measurement device (LA-920, manufactured by HORIBA, Ltd.). A part of Fine Particle Dispersion Liquid 5 was dried so that the resin part was isolated therefrom. The resin part had Tg of 58° C., and a weight average molecular weight of 140,000.

Comparative Example 2

Production of Toner 15

Toner 15 was produced in the same manner as in Example 1, except that Aqueous Phase 1 was replaced with Aqueous Phase 10.

—Preparation of Aqueous Phase 10—

Water (1,013 parts by mass), 60 parts by mass of Fine Particle Dispersion Liquid 1 and 37 parts by mass of a 48.3% by mass aqueous solution of sodium dodecyldiphenyl ether disulfonate (ELEMINOL MON-7, manufactured by Sanyo Chemical Industries, Ltd.) and 90 parts by mass of ethyl acetate were mixed and stirred, to thereby obtain an opaque white liquid. This was defined as Aqueous Phase 10.

Comparative Example 3

Production of Toner 16

Toner 16 was produced in the same manner as in Example 1, except that Resin Fine Particle Emulsion 1 was replaced with Resin Fine Particle Emulsion 6 (Fine Particle Dispersion Liquid 6).

—Synthesis of Resin Fine Particle Emulsion 6 (Fine Particle Dispersion Liquid 6—

Into a reaction vessel equipped with a stirring rod and a thermometer, 683 parts by mass of water, 11 parts by mass of sodium salt of methacrylic acid ethylene oxide adduct sulfate ester (ELEMINOL RS-30, manufactured by Sanyo Chemical Industries, Ltd.), 10 parts by mass of polylactic acid, 60 parts by mass of styrene, 100 parts by mass of methacrylic acid, 70 parts by mass of butyl acrylate, and 1 part by mass of ammonium persulfate were charged and then stirred at 1,500 rpm for 20 minutes, to thereby obtain a white emulsion. Then, the temperature of the reaction system was raised to 75° C. by heating and reacted for 3 hours. Further, 30 parts by mass of a 1% by mass aqueous ammonium persulfate solution was added to the reaction system and aged at 65° C. for 12 hours, to thereby obtain an aqueous dispersion liquid of a vinyl resin (a copolymer of styrene-methacrylate-butyl acrylate-sodium salt of methacrylic acid ethylene oxide adduct sulfate ester), i.e., Fine Particle Dispersion Liquid 6. The volume average particle diameter of Fine Particle Dispersion Liquid 6 was 720 nm as measured with a particle size distribution measurement device (LA-920, manufactured by HORIBA, Ltd.). A part of Fine Particle Dispersion Liquid 6 was dried so that the resin part was isolated therefrom. The resin part had Tg of 57° C., and a weight average molecular weight of 120,000.

Comparative Example 4

Production of Toner 17

Toner 17 was produced in the same manner as in Example 1, except that Low Molecular Weight Polyester 1 was replaced with Low Molecular Weight Polyester 4.

—Synthesis of Low Molecular Weight Polyester Resin 4—

Into a reaction vessel equipped with a cooling tube, a stirrer, and a nitrogen-introducing tube, 350 parts by mass of bisphenol A ethylene oxide (2 mol) adduct, 326 parts by mass of bisphenol A propylene oxide (3 mol) adduct, 278 parts by mass of terephthalic acid, 40 parts by mass of phthalic anhydride, 2 parts by mass of titaniumdihydroxybis(triethanolaminate) as a condensation catalyst were charged, and the mixture was allowed to react at 220° C. for 8 hours under a nitrogen stream while water generated was distilled away. Next, the reaction product was allowed to further react under reduced pressure of 5 mmHg to 20 mmHg, and was cooled to 180° C. when the reaction product had an acid value of 2 mgKOH/g or less, followed by adding 62 parts by mass of trimellitic anhydride thereto, and reacting the mixture for 2 hours under a normal pressure while sealed. Then, the resultant product was taken out from the sealed vessel, cooled to room temperature, and pulverized, to thereby obtain Low Molecular Weight Polyester Resin 4. The Low Molecular Weight Polyester Resin 4 had a number average molecular weight of 4,020, a weight average molecular weight of 93,800, a glass transition temperature Tg of 68° C., and an acid value of 35 mgKOH/g.

Comparative Example 5

Production of Toner 18

Toner 18 was produced in the same manner as in Example 1, except that Aqueous Phase 1 was replaced with Aqueous Phase 11.

—Preparation of Aqueous Phase 11—

Water (1,013 parts by mass), 60 parts by mass of Fine Particle Dispersion Liquid 1 and 37 parts by mass of a 48.3% by mass aqueous solution of sodium dodecyldiphenyl ether disulfonate (ELEMINOL MON-7, manufactured by Sanyo Chemical Industries, Ltd.) and 90 parts by mass of ethyl acetate were mixed and stirred, to thereby obtain an opaque white liquid. This was defined as Aqueous Phase 11.

Comparative Example 6

Production of Toner 19

Toner 19 was produced in the same manner as in Example 1, except that Aqueous Phase 1 and Low Molecular Weight Polyester Resin 1 were replaced with Aqueous Phase 12 and Low Molecular Weight Polyester Resin 3.

—Preparation of Aqueous Phase 12—

Water (950 parts by mass), 123 parts by mass of Fine Particle Dispersion Liquid 1 and 37 parts by mass of a 48.3% by mass aqueous solution of sodium dodecyldiphenyl ether disulfonate (ELEMINOL MON-7, manufactured by Sanyo Chemical Industries, Ltd.) and 90 parts by mass of ethyl acetate were mixed and stirred, to thereby obtain an opaque white liquid. This was defined as Aqueous Phase 12.

Comparative Example 7

Production of Toner 20

Toner 20 was produced in the same manner as in Example 1, except that Aqueous Phase 1 and Low Molecular Weight Polyester Resin 1 were replaced with Aqueous Phase 13 and Low Molecular Weight Polyester Resin 2.

—Preparation of Aqueous Phase 13—

Water (1,000 parts by mass), 73 parts by mass of Fine Particle Dispersion Liquid 1 and 37 parts by mass of a 48.3% by mass aqueous solution of sodium dodecyldiphenyl ether disulfonate (ELEMINOL MON-7, manufactured by Sanyo Chemical Industries, Ltd.) and 90 parts by mass of ethyl acetate were mixed and stirred, to thereby obtain an opaque white liquid. This was defined as Aqueous Phase 13.

Next, the various physical properties of the produced toners 1 to 20 were measured as follows. The results are shown in Tables 1 to 3.

<Evaluation of Softening Index Ct and Thermal Hardness St>

The softening index Ct and the thermal hardness St of each toner were evaluated by the following method.

—Softening Index Ct—

The softening index Ct was evaluated using an elevated flow tester CFT-500D, manufactured by Shimadzu Corporation, in accordance with a method described in JIS K7210. Specifically, 1 g of a toner was pressure-molded into a cylindrical-shaped tablet having 10 mm diameter and 10 mm height, and was placed in a test instrument shown in FIG. 1A. The tablet was heated at a temperature increasing rate of 3° C./min from a starting temperature of 50° C. while 25 kgf load was applied to the tablet with a plunger, so as to extrude the melted toner through a nozzle having 0.5 mm diameter and 1 mm length. Thus, a plunger descent amount-temperature curve was plotted, and Tfb at 25 kgf load was determined. The flow beginning temperature Tfb is a softening index Ct.

—Thermal Hardness St—

Thermal Hardness St was evaluated in accordance with a method described in JIS K7210 using an elevated flow tester CFT-500D, manufactured by Shimadzu Corporation. The flow beginning temperature Tfb of each toner was measured in the same manner as the softening index Ct thereof, except that the load was changed to 2 kgf, 10 kgf, and 25 kgf.

Next, the relation between a load and a flow beginning temperature Tfb to be measured at the load was plotted on an x-y plane, with a load on the x axis, in which a unit of the x axis is kgf, and Tfb on the y axis, in which a unit of the y axis is temperature ° C. Thereafter, a linear function (y=ax+b) was determined from the plot by a least-square method. The absolute value of a slope "a" of the linear function was a thermal hardness St.

In Table 1, Tfb and St of each toner at each load are shown.

TABLE 1

| | Flow beginning temperature Tfb (° C.) | | | Thermal hardness |
|---|---|---|---|---|
| | 2 kgf | 10 kgf | 25 kgf | St |
| Ex. 1 | 122 | 99 | 88 | 1.4 |
| Ex. 2 | 126 | 100 | 86 | 1.6 |
| Ex. 3 | 139 | 110 | 95 | 1.8 |
| Ex. 4 | 113 | 99 | 93 | 0.8 |
| Ex. 5 | 106 | 92 | 86 | 0.8 |
| Ex. 6 | 115 | 102 | 95 | 0.8 |
| Ex. 7 | 120 | 99 | 86 | 1.4 |
| Ex. 8 | 129 | 109 | 95 | 1.4 |
| Ex. 9 | 130 | 103 | 86 | 1.8 |

TABLE 1-continued

| | Flow beginning temperature Tfb (° C.) | | | Thermal hardness |
|---|---|---|---|---|
| | 2 kgf | 10 kgf | 25 kgf | St |
| Ex. 10 | 104 | 91 | 86 | 0.7 |
| Ex. 11 | 105 | 92 | 86 | 0.8 |
| Ex. 12 | 116 | 102 | 90 | 1.1 |
| Ex. 13 | 129 | 108 | 95 | 1.4 |
| Comp. Ex. 1 | 101 | 92 | 87 | 0.6 |
| Comp. Ex. 2 | 103 | 92 | 88 | 0.6 |
| Comp. Ex. 3 | 142 | 115 | 96 | 1.9 |
| Comp. Ex. 4 | 133 | 109 | 97 | 1.5 |
| Comp. Ex. 5 | 95 | 87 | 83 | 0.5 |
| Comp. Ex. 6 | 130 | 101 | 84 | 1.9 |
| Comp. Ex. 7 | 110 | 103 | 96 | 0.6 |

<Confirmation of Presence of Shell and Evaluation of Shell Thickness>

The presence of a shell of the toner was confirmed and a shell thickness of the toner was evaluated by the following method using a transmission electron microscope TEM. The shell thickness of randomly selected 10 toners were measured by the following method, and an average value thereof was defined as a shell thickness.

Firstly, approximately one spatula of a toner was embedded in an epoxy resin, and then the epoxy resin was cured to obtain a sample. The sample was cut out with a knife to reveal the cross section thereof and an ultra thin section having 200 nm-thick of the toner was prepared using an ultramicrotome (ULTRACUT UCT manufactured by Leica, with the use of a diamond knife). The cut-out sample was exposed to ruthenium tetroxide for 5 minutes so as to dye a shell and a core for identification. The exposure time was appropriately adjusted depending on the contrast during the observation. And then, the ultra thin section of the toner was observed by a transmission electron microscope TEM, H7000 manufactured by Hitachi High-Technologies Corporation at an acceleration voltage of 100 kV. Depending on the compositions of a core and a shell, they could be identified without dyeing. In such a case, the sample might be evaluated without dyeing. Alternatively, the contrast of the composition could be obtained by other means such as selective etching. After such pretreatment, a sample was observed using a transmission electron microscope TEM, to thereby measure a shell thickness.

<Average Circularity>

The average circularity of the toner was measured using a flow-type particle image analyzer ("FPIA-2100," manufactured by SYSMEX CORPORATION), and analyzed using an analysis software (FPIA-2100 Data Processing Program for FPIA Version00-10). Specifically, into a 100 mL glass beaker, 0.5 mL of a 10% by mass surfactant (NEOGEN SC-A, an alkylbenzene sulfonate, manufactured by Dai-ichi Kogyo Seiyaku Co., Ltd.) was charged, and 0.5 g of a toner was added, followed by stirring with a microspatula. Subsequently, 80 mL of ion-exchanged water was added to the beaker. The obtained dispersion liquid was subjected to dispersion treatment for 3 min using an ultrasonic wave dispersing device (manufactured by Honda Electronics Co., Ltd.). Using FPIA-2100, the shape and distribution of toner particles were measured until the dispersion liquid has a concentration of approximately 15,000 number per μL.

<Shape Factor>

Shape factors SF-1 and SF-2 of each toner were measured as follows. FE-SEM images of toners were taken using FE-SEM (S-4200, by Hitachi, Ltd.), and 300 images were randomly sampled, and were inputted into an image analyzer Luzex AP (by NIRECO CORPORATION) through an interface and analyzed, followed by calculating from the following equations.

$$SF\text{-}1=(L^2/A)\times(\pi/4)\times 100$$

$$SF\text{-}2=(P^2/A)\times(1/4\pi)\times 100$$

In the equations, L denotes an absolute maximum length of a toner; A denotes a projected area of the toner; and P denotes a maximum peripheral length of the toner.

<Weight Average Particle Diameter, and Weight Average Particle Diameter/Number Average Particle Diameter>

Of the toner, a weight average particle diameter $D_4$ of a toner, a number average particle diameter $D_n$ of a toner, and a ratio $D_4/D_n$ of the weight average particle diameter $D_4$ to the number average particle diameter ($D_n$) were measured using COULTER MULTISIZER II. A measurement method will be described below.

First, as a dispersant, 5 mL of a surfactant (preferably, polyoxyethylene alkyl ether, nonionic surfactant) was added to 150 mL of an electrolytic aqueous solution. Note that the electrolytic aqueous solution was a 1% by mass NaCl aqueous solution prepared using primary sodium chloride, for example, ISOTON-II (manufactured by Beckmann Coulter Inc.). Subsequently, 20 mg of a sample to be measured was further added. The electrolytic aqueous solution in which the sample was suspended was subjected to dispersion treatment for 3 minutes using an ultrasonic dispersion device. By the measurement apparatus using 100 μm-aperture, the weight and the number of toner particles or a toner were measured, and then its weight distribution and number distribution were calculated. From these distributions, the weight average particle diameter $D_4$ and the number average particle diameter Dn of the toner were obtained.

In the measurement, the following 13 channels were used to measure particles having diameters of 2.00 μm or greater and smaller than 40.30 μm: a channel having a diameter of 2.00 μm or greater and smaller than 2.52 μm, a channel having a diameter of 2.52 μm or greater and smaller than 3.17 μm; a channel having a diameter of 3.17 μm or greater and smaller than 4.00 μm; a channel having a diameter of 4.00 μm or greater and smaller than 5.04 μm; a channel having a diameter of 5.04 μm or greater and smaller than 6.35 μm; a channel having a diameter of 6.35 μm or greater and smaller than 8.00 μm; a channel having a diameter of 8.00 μm or greater and smaller than 10.08 μm; a channel having a diameter of 10.08 μm or greater and smaller than 12.70 μm; a channel having a diameter of 12.70 μm or greater and smaller than 16.00 μm; a channel having a diameter of 16.00 μm or greater and smaller than 20.20 μm; a channel having a diameter of 20.20 μm or greater and smaller than 25.40 μm; a channel having a diameter of 25.40 μm or greater and smaller than 32.00 μm; and a channel having a diameter of 32.00 μm or greater and smaller than 40.30 μm.

TABLE 2

| | Core-shell structure | Thermal hardness St | Softening index Ct | Shell thickness (μm) |
|---|---|---|---|---|
| Ex. 1 | Presence | 1.4 | 88 | 0.6 |
| Ex. 2 | Presence | 1.6 | 86 | 1.1 |
| Ex. 3 | Presence | 1.8 | 95 | 1.8 |
| Ex. 4 | Presence | 0.8 | 93 | 0.2 |
| Ex. 5 | Presence | 0.8 | 86 | 0.1 |
| Ex. 6 | Presence | 0.8 | 95 | 0.6 |
| Ex. 7 | Presence | 1.4 | 86 | 0.6 |
| Ex. 8 | Presence | 1.4 | 95 | 0.9 |
| Ex. 9 | Presence | 1.8 | 86 | 0.9 |

TABLE 2-continued

| | Core-shell structure | Thermal hardness St | Softening index Ct | Shell thickness (μm) |
|---|---|---|---|---|
| Ex. 10 | Presence | 0.7 | 86 | 0.1 |
| Ex. 11 | Presence | 0.8 | 86 | 0.2 |
| Ex. 12 | Presence | 1.1 | 90 | 0.6 |
| Ex. 13 | Presence | 1.4 | 95 | 0.9 |
| Comp. Ex. 1 | Absence | 0.6 | 87 | Not detected |
| Comp. Ex. 2 | Presence | 0.6 | 88 | 0.5 |
| Comp. Ex. 3 | Presence | 1.9 | 96 | 2.0 |
| Comp. Ex. 4 | Presence | 1.5 | 97 | 0.7 |
| Comp. Ex. 5 | Presence | 0.5 | 83 | 0.4 |
| Comp. Ex. 6 | Presence | 1.9 | 84 | 0.9 |
| Comp. Ex. 7 | Presence | 0.6 | 96 | 0.5 |

In Comparative Example 1, a shell was not detected, because the particle diameters of the resin fine particles were small, i.e., 105 nm, and the shell having enough thickness to be detected could not be formed after a toner was formed.

TABLE 3

| | Average circularity | Shape factor SF-1 | Shape factor SF-2 | Particle size: Weight average particle diameter $D_4$ | Particle size: Number average particle diameter $D_n$ | $D_4/D_n$ |
|---|---|---|---|---|---|---|
| Ex. 1 | 0.96 | 131 | 120 | 4.7 | 4.4 | 1.07 |
| Ex. 2 | 0.94 | 128 | 130 | 4.5 | 3.8 | 1.18 |
| Ex. 3 | 0.98 | 118 | 120 | 3.2 | 2.7 | 1.19 |
| Ex. 4 | 0.95 | 130 | 138 | 4.8 | 4.2 | 1.14 |
| Ex. 5 | 0.96 | 130 | 137 | 4.3 | 4.0 | 1.08 |
| Ex. 6 | 0.95 | 128 | 126 | 4.1 | 3.7 | 1.11 |
| Ex. 7 | 0.96 | 129 | 124 | 4.6 | 4.3 | 1.07 |
| Ex. 8 | 0.94 | 127 | 123 | 4.3 | 4.0 | 1.08 |
| Ex. 9 | 0.95 | 129 | 124 | 4.9 | 4.6 | 1.07 |
| Ex. 10 | 0.95 | 129 | 126 | 4.6 | 4.4 | 1.05 |
| Ex. 11 | 0.96 | 130 | 128 | 4.5 | 4.3 | 1.05 |
| Ex. 12 | 0.93 | 140 | 143 | 4.1 | 3.6 | 1.14 |
| Ex. 13 | 0.98 | 110 | 106 | 4.2 | 4.0 | 1.05 |
| Comp. Ex. 1 | 0.98 | 117 | 122 | 5.0 | 4.1 | 1.22 |
| Comp. Ex. 2 | 0.96 | 133 | 124 | 5.1 | 4.2 | 1.21 |
| Comp. Ex. 3 | 0.94 | 139 | 155 | 5.4 | 4.3 | 1.26 |
| Comp. Ex. 4 | 0.94 | 152 | 157 | 7.1 | 5.8 | 1.22 |
| Comp. Ex. 5 | 0.95 | 150 | 157 | 5.1 | 4.2 | 1.21 |
| Comp. Ex. 6 | 0.95 | 130 | 125 | 4.8 | 4.1 | 1.17 |
| Comp. Ex. 7 | 0.96 | 128 | 124 | 4.4 | 3.7 | 1.19 |

Next, two-component developers using the toners were produced and evaluated as follows.

<Production of Two-Component Developer>

A two-component developer was produced using the resultant toner and a carrier. Specifically, using a ferrite carrier having an average particle diameter of 35 μm and being coated with a silicone resin of 0.5 μm thick in average, 7 parts by mass of respective toners and 100 parts by mass of the carrier were uniformly mixed using a tubular mixer including a container that was tumbled for stirring, and then charged to thereby produce the two-component developer.

—Production of Carrier—

Core Material

| | |
|---|---|
| Mn ferrite particles (weight average particle diameter: 35 μm) | 5,000 parts by mass |

Coating Material

| | |
|---|---|
| toluene | 450 parts by mass |
| silicone resin SR2400, manufactured by Dow Corning Toray Co., Ltd., non-volatile content: 50% | 450 parts by mass |
| amino silane SH6020, manufactured by Dow Corning Toray Co., Ltd. | 10 parts by mass |
| carbon black | 10 parts by mass |

The coating materials were dispersed with a stirrer for 10 minutes to prepare a coating liquid, and the coating liquid and the core material were charged into a coating device for applying the coating liquid onto the core material while swirling them by use of a rotatable bottom disc and stirring blade within a fluidized bed. The coated product was fired in an electric furnace at 250° C. for 2 hours to prepare the carrier.

<Evaluation Device>

As an evaluation device, IMAGIO MP C600, manufactured by Ricoh Company, Ltd., in which a developing part and fixing part were converted, was used. The converted device was used under the conditions that a development gap was 1.26 mm, a doctor blade gap was 1.6 mm, and a reflection photo sensor was switched off, so that a linear velocity of a system became 1,700 mm/sec. The fixing unit of the fixing part had a fixed surface pressure of 39 N/cm$^2$ and a fixing nip width of 10 mm. Onto a surface of a fixing member, a tetrafluoroethylene-perfluoroalkyl vinyl ether copolymer resin (PFA) was applied, molded, and then surface-adjusted to be used. The area of an image bearing member, a developing unit, and a transferring unit was controlled at the temperature of 30° C. to 45° C. The heating temperature of a fixing roller was 130° C.

A linear velocity of a system was obtained in the following manner: A4-size paper was fed in a longitudinal direction (the length of paper in the paper feeding direction was 297 mm) and 100 sheets thereof were continuously output by an image forming apparatus. When the output time from start to end was defined as A second, and a linear velocity of a system was defined as B, the linear velocity of a system was found by the following equation:

$$B(\text{mm/sec})=100\ \text{sheets}\times 297\ \text{mm}/A\ \text{second}$$

A fixed surface pressure was measured with a pressure distribution measurement system, PINCH (manufactured by NITTA CORPORATION).

—Low Temperature Fixing Ability at High Temperature and High Humidity—

After output of 10,000 sheets of an image chart with a 3% image area at high temperature and high humidity, i.e., a temperature of 45° C. and humidity of 80% using each of the obtained two-component developers and the evaluation device, images were output as the temperature of the fixing roller was changed by 5° C. and the low temperature fixing ability was measured. As transfer paper, full-color PPC paper type 6200 (manufactured by Ricoh Company, Ltd.) was used.

The fixing temperature of the fixing roller was changed so as to obtain a printed image having an image density of 1.2 measured with X-RITE 938. A copy image at each temperature was rubbed 50 times with a sand rubber eraser mounted on a clock meter, and an image density of the image before being rubbed off and that after being rubbed off were measured and found a fixation ratio by the following equation.

Fixation ratio(%)=(image density after being rubbed off with a sand rubber eraser 10 times/image density before being rubbed off with the sand rubber eraser)×100

Then, a temperature at which the fixation ratio was 70% or more was defined as a lower limit fixing temperature. The low temperature fixing ability was evaluated on the basis of the following evaluation criteria. The results are shown in Table 4.

Evaluation Criteria

A: The lower limit fixing temperature was 100° C. or lower.

B: The lower limit fixing temperature was higher than 100° C. and 120° C. or lower.

C: The lower limit fixing temperature was higher than 120° C. and 130° C. or lower.

D: The lower limit fixing temperature was higher than 130° C.

—Evaluation of Carrier Spent at High Temperature and High Humidity—

After 100,000 sheets of an image chart with a 20% image area were output at high temperature and high humidity, i.e., a temperature of 45° C. and humidity of 80% using each of the obtained two-component developers and the evaluation device, the developer was taken out, and placed in a cylindrical cage, in which wire meshes were arranged at both ends. The toner was separated from the developer by high-pressure air, so as to collect a carrier. The spent properties of the carrier was evaluated by observing a cross-section of the carrier. The carrier was embedded in a resin, and then a cross section of the carrier was produced using a cross section polisher (IB-09010CP, manufactured by JEOL Ltd.), followed by observing and evaluating a spent material using a scanning electron microscope FE-SEM (Ultra55, manufactured by Carl Zeiss). The 10 cut carrier particles were randomly selected, and a thickness of a spent layer was analyzed with an image processing software, and then spent properties was evaluated based on the following evaluation criteria. The results are shown in Table 4.

TABLE 4

| | Low temperature fixing ability at high temperature and high humidity | Spent properties of carrier at high temperature and high humidity |
|---|---|---|
| Ex. 1 | B | B |
| Ex. 2 | B | B |
| Ex. 3 | B | A |
| Ex. 4 | A | B |
| Ex. 5 | A | B |
| Ex. 6 | A | B |
| Ex. 7 | B | B |
| Ex. 8 | B | A |
| Ex. 9 | B | A |
| Ex. 10 | B | B |
| Ex. 11 | A | B |
| Ex. 12 | B | B |
| Ex. 13 | B | A |
| Comp. Ex. 1 | D | D |
| Comp. Ex. 2 | D | D |
| Comp. Ex. 3 | D | C |
| Comp. Ex. 4 | D | B |
| Comp. Ex. 5 | B | D |
| Comp. Ex. 6 | D | B |
| Comp. Ex. 7 | B | D |

A: A spent layer was not observed.

B: A spent layer had a thickness of 100 nm or less.

C: A spent layer had a thickness of more than 100 nm and 200 nm or less.

D: A spent layer had a thickness of more than 200 nm.

The toner of the present invention satisfies both low temperature fixing ability and prevention of carrier spent at high temperature and high humidity, and suitably used for high quality image formation. Then, a two-component developer, a process cartridge, and an image forming apparatus, which use the toner of the present invention are suitably used for high quality image formation by electrophotography.

What is claimed is:

1. A toner comprising:

a first binder resin;

a second binder resin;

a colorant;

a releasing agent; and a crystalline polyester resin, wherein:

the toner has a core-shell structure, such that a core comprises at least the first binder resin, the colorant and the releasing agent, and a shell comprises at least the second binder resin; and the toner has a softening index of 86° C. to 95° C. and a thermal hardness of 0.7 to 1.8.

2. The toner according to claim 1, wherein the shell has a thickness of 0.01 μm to 2.0 μm.

3. The toner according to claim 1, wherein the second binder resin comprises a vinyl resin.

4. The toner according to claim 1, wherein the first binder resin comprises a polyester resin.

5. The toner according to claim 1, wherein the first binder resin comprises an unmodified polyester resin.

6. The toner according to claim 1, wherein the toner is obtained by a method comprising containing dispersing or emulsifying any of an oil phase and a monomer phase, which comprises any of a toner composition and a toner composition precursor in an aqueous medium.

7. The toner according to claim 6, wherein:

the toner composition comprises a polymer having a site reactive with an active hydrogen group-containing compound, the crystalline polyester resin, the colorant, and the releasing agent; and the toner composition is subjected to any of crosslinking reaction and elongation reaction in the aqueous medium in the presence of resin fine particles.

8. The toner according to claim 1, wherein the toner has an average circularity of 0.93 to 0.99.

9. The toner according to claim 1, wherein the toner has a shape factor SF-1 of 100 to 150, and a shape factor SF-2 of 100 to 140.

10. The toner according to claim 1, wherein the toner has a weight average particle diameter $D_4$ of 2 μm to 7 μm, and a ratio $D_4/D_n$ of the weight average particle diameter $D_4$ to a number average particle diameter $D_n$ of 1.25 or less.

11. The toner according to claim 1, wherein the toner has a thermal hardness of 0.7 to 1.4.

12. The toner according to claim 1, wherein the shell has a thickness of 0.1 μm to 1.0 μm.

* * * * *